US010237937B2

(12) United States Patent
Kido et al.

(10) Patent No.: US 10,237,937 B2
(45) Date of Patent: Mar. 19, 2019

(54) LIGHTING DEVICE

(71) Applicant: PANASONIC INTELLECTUAL PROPERTY MANAGEMENT CO., LTD., Osaka (JP)

(72) Inventors: Hiroshi Kido, Osaka (JP); Shigeru Ido, Osaka (JP); Hisao Kataoka, Osaka (JP); Naohiro Toda, Chiba (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/898,458

(22) Filed: Feb. 17, 2018

(65) Prior Publication Data

US 2018/0255617 A1 Sep. 6, 2018

(30) Foreign Application Priority Data

Mar. 1, 2017 (JP) ..... 2017-038168

(51) Int. Cl.
*H05B 37/02* (2006.01)
*H05B 33/08* (2006.01)

(52) U.S. Cl.
CPC ..... *H05B 33/0845* (2013.01); *H05B 33/086* (2013.01); *H05B 33/0809* (2013.01); *H05B 33/0857* (2013.01); *H05B 37/0209* (2013.01); *H05B 37/029* (2013.01)

(58) Field of Classification Search
CPC ..... H05B 37/029; H05B 33/0845; H05B 37/0209; H05B 33/0857; H05B 33/0809; H05B 33/086
USPC ..... 315/291
See application file for complete search history.

(56) References Cited

U.S. PATENT DOCUMENTS 7,425,802 B2 * 9/2008 Kumagai ..... H05B 41/288 315/209 R
7,483,021 B2 * 1/2009 Yamamoto ..... H05B 33/0818 345/1.1
9,420,644 B1 * 8/2016 Shum ..... H05B 33/089
2009/0278473 A1 * 11/2009 Van Erp ..... H02J 13/0003 315/294
2011/0068712 A1 * 3/2011 Young ..... H05B 33/0815 315/307
2015/0188412 A1 7/2015 Imanaka
(Continued)

FOREIGN PATENT DOCUMENTS

JP 2011-48955 A 3/2011
WO 2016/088000 A1 6/2016

OTHER PUBLICATIONS

Extended European Search Report dated Jul. 12, 2018 for corresponding European App. No. 18157303.1.

*Primary Examiner* — Don P Le
(74) *Attorney, Agent, or Firm* — Renner Otto Boisselle & Sklar, LLP

(57) ABSTRACT

A lighting device is provided that includes a lighting controller that controls a light emitter that emits illumination light. The lighting controller includes a first filter that converts a first signal waveform that is defined by a first piecewise linear curve and whose intensity repeatedly increases and decreases into a signal waveform having a smooth rounded curve, and outputs the converted signal waveform as a first output waveform. The lighting controller causes the light emitter to repeatedly increase and decrease the intensity of the illumination light in accordance with the first output waveform.

19 Claims, 19 Drawing Sheets

(56) References Cited

U.S. PATENT DOCUMENTS

| | | | | |
|---|---|---|---|---|
| 2016/0226593 | A1* | 8/2016 | Ganick | H04B 10/116 |
| 2017/0265265 | A1 | 9/2017 | Clout | |
| 2018/0255617 | A1* | 9/2018 | Kido | H05B 33/086 |

* cited by examiner

LIGHTING DEVICE

CROSS REFERENCE TO RELATED APPLICATION

This application claims the benefit of priority of Japanese Patent Application Number 2017-038168 filed on Mar. 1, 2017, the entire content of which is hereby incorporated by reference.

BACKGROUND

1. Technical Field

The present disclosure relates to lighting devices.

2. Description of the Related Art

A luminaire that reproduces the natural brightness and flicker of the flame of, for example, a candle, is known (for example, see Japanese Unexamined Patent Application Publication No. 2011-48955). The luminaire disclosed in Japanese Unexamined Patent Application Publication No. 2011-48955 includes a light emitting body, a frequency generator that applies a predetermined frequency to the light emitting body, and storage that stores energy change data. The frequency generator changes the applied frequency to change the brightness of the light emitting body.

SUMMARY

However, the conventional lighting device described above includes a plurality of frequency generators which complicates the configuration.

In view of this, the present disclosure has an object to provide a lighting device that can increase and decrease illumination light intensity with a simple configuration.

In order to achieve the object described above, a lighting device according to one aspect of the present disclosure includes a lighting controller that controls a light emitter that emits illumination light. The lighting controller includes a first filter that converts a first signal waveform that is defined by a first piecewise linear curve and whose intensity repeatedly increases and decreases into a signal waveform defined by a smooth rounded curve, and outputs the converted signal waveform as a first output waveform. The lighting controller causes the light emitter to repeatedly increase and decrease an intensity of the illumination light in accordance with the first output waveform.

Moreover, an electronic device according to one aspect of the present disclosure includes the lighting device and the light emitter.

Moreover, a lighting fixture according to one aspect of the present disclosure includes the lighting device and the light emitter.

With the present disclosure, it is possible to provide a lighting device that can increase and decrease illumination light intensity with a simple configuration.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

The following describes a lighting device, electronic device, and lighting fixture according to exemplary embodiments of the present disclosure. Each of the embodiments described below is merely one specific example of the present disclosure. The numerical values, shapes, materials, elements, arrangement and connection of the elements, steps, and order of the steps, etc., indicated in the following embodiments are given merely by way of illustration and are not intended to limit the present disclosure. Therefore, among elements in the following embodiments, those not recited in any one of the independent claims defining the broadest inventive concept of the present disclosure are described as optional elements.

Note that the figures are schematic illustrations and are not necessarily precise depictions. Accordingly, the figures are not necessarily to scale. Moreover, in the figures, elements that are essentially the same share like reference signs. Accordingly, duplicate description is omitted or simplified. Moreover, in the following embodiments, "approximately" means, for example, in the case of "approximately the same," not only exactly the same, but essentially the same as well. In other words, "approximately" allows for a margin of error of about a few percent, for example. The same applies to other phrases using the terminology "approximately".

Embodiment 1

(Outline)

Figure 1:
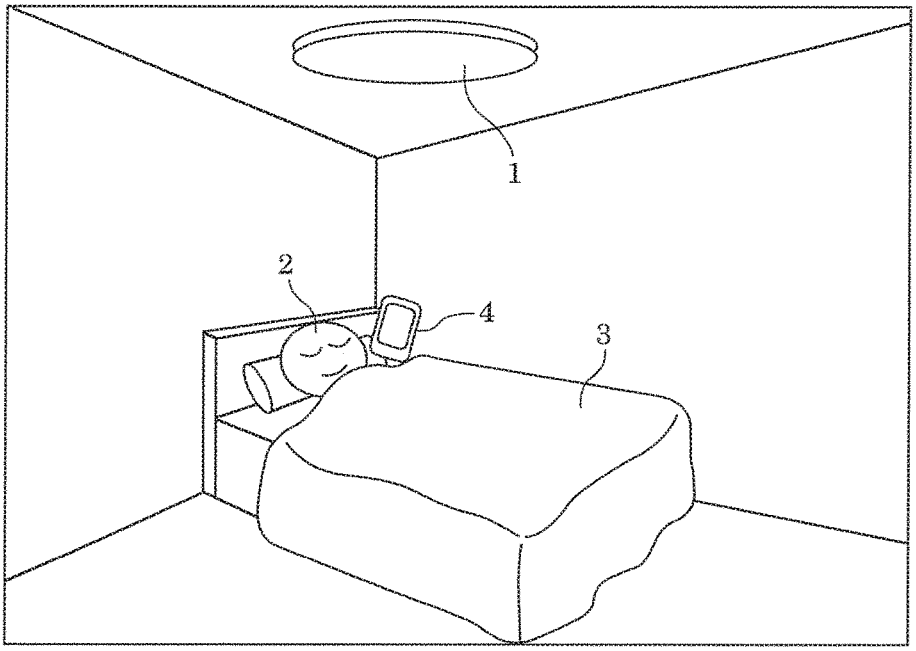
FIG. 1 illustrates a schematic view of one example of an environment in which a lighting fixture including a lighting device according to Embodiment 1 is used.

First, an outline of the lighting device according to Embodiment 1 will be given with reference to FIG. 1. FIG. 1 illustrates a schematic view of one example of an environment in which lighting fixture 1 including lighting device 100 (see FIG. 2) according to this embodiment is used.

In this embodiment, as illustrated in FIG. 1, lighting fixture 1 is a ceiling light attached to a bedroom ceiling, and illuminates the entire bedroom. Accordingly, when lying on bed 3, user 2 is exposed to the illumination light emitted by lighting fixture 1. Lighting fixture 1 can pleasantly lull user 2 to sleep by emitting illumination light whose intensity repeatedly increases and decreases (i.e., flickering illumination light). The flickering illumination light emitted by lighting fixture 1 is generated by lighting device 100 included in lighting fixture 1. Lighting fixture 1 need not be embodied as a ceiling light; lighting fixture 1 may be embodied as any device that emits illumination light, such as a down light, spot light, bracket light, or floor light.

Note that the device that emits flickering illumination light need not be lighting fixture 1. For example, as illustrated in FIG. 1, electronic device 4, such as a smartphone, may emit flickering illumination light. In other words, electronic device 4 may include lighting device 100. Electronic device 4 is not limited to a smartphone; electronic device 4 is any device including a light emitting unit, such as a projector or television.

(Configuration)

Figure 2:
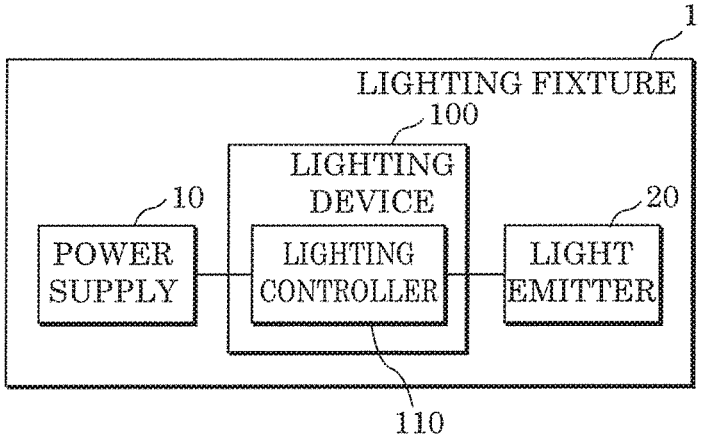
FIG. 2 illustrates a functional block diagram of the configuration of a lighting fixture including a lighting device according to Embodiment 1.
Figure 3:
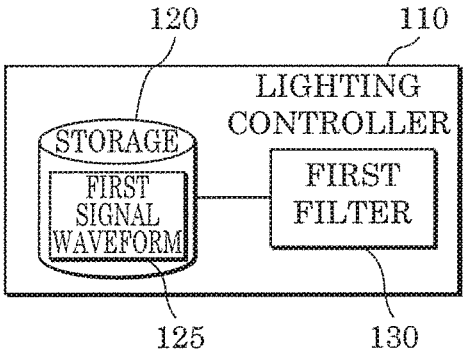
FIG. 3 illustrates a functional block diagram of the configuration of a lighting controller included in a lighting device according to Embodiment 1.

Next, the configurations of lighting fixture 1 and lighting device 100 according to Embodiment 1 will be described with reference to FIG. 2 and FIG. 3. FIG. 2 illustrates a functional block diagram of the configuration of lighting fixture 1 including lighting device 100 according to this embodiment. FIG. 3 illustrates a functional block diagram of the configuration of lighting controller 110 included in lighting device 100 according to this embodiment.

As illustrated in FIG. 2, lighting fixture 1 includes power supply 10, light emitter 20, and lighting device 100.

Power supply 10 supplies power to lighting device 100 and light emitter 20. For example, power supply 10 includes a power receiving circuit that receives AC power from, for example, a utility power source, and a converter circuit that converts the received AC power into DC power. Power supply 10 may be, for example, a removable energy storage device.

Light emitter 20 emits illumination light. More specifically, light emitter 20 includes one or more light sources. A light source is a light emitting element such as a light emitting diode (LED). Note that a light source may be a solid state light emitting element such as a laser element or organic electroluminescent (EL) element, and may be a discharge lamp such as a fluorescent lamp.

Light emitter 20 is equipped with a dimming function. In other words, light emitter 20 can change the intensity (brightness) of emitted illumination light. More specifically, light emitter 20 can emit illumination light of an intensity determined by lighting device 100 in a range of from completely off (0 light output; 0% dimming rate) to fully on (maximum light output; 100% dimming rate). For example, light emitter 20 emits flickering illumination light by repeatedly increasing and decreasing intensity based on control by lighting device 100.

Lighting device 100 is a device that turns on, turns off, and controls, for example, the dimming of light emitter 20.

As illustrated in FIG. 2, lighting device 100 includes lighting controller 110 that controls light emitter 20.

Note that lighting device 100 may include an input receiver (not illustrated in the drawings) for receiving an input from user 2. The input receiver receives, for example, an "on" instruction for turning on light emitter 20, an "off" instruction for turning off light emitter 20, and a dimming instruction that determines the intensity of the illumination light. The input receiver may further receive, for example, a mode instruction that determines the mode of operation of light emitter 20.

Lighting controller 110 causes light emitter 20 to operate in flicker mode. In flicker mode, the intensity of the illumination light repeatedly increases and decreases while gradually decreasing over time from a normal "on" state (a state in which the intensity of the illumination light is constant) to an "off" state. When in flicker mode, light emitter 20 emits flickering illumination light whose intensity gradually decreases. A detailed example of operations performed in flicker mode and a detailed example of flickering illumination light will be given later.

Lighting controller 110 may cause light emitter 20 to operate in a normal mode. In normal mode, illumination light intensity remains constant. Illumination light intensity in normal mode is determined by, for example, a dimming instruction received from user 2 via the input receiver.

In this embodiment, as illustrated in FIG. 3, lighting controller 110 includes storage 120 and first filter 130. Lighting controller 110 is embodied as, for example, a microcontroller, but may be embodied as dedicated circuitry.

Storage 120 is memory for storing first signal waveform 125. First signal waveform 125 is a waveform of a signal that forms the basis of a control signal for changing the intensity of the illumination light emitted by light emitter 20.

Figure 4:
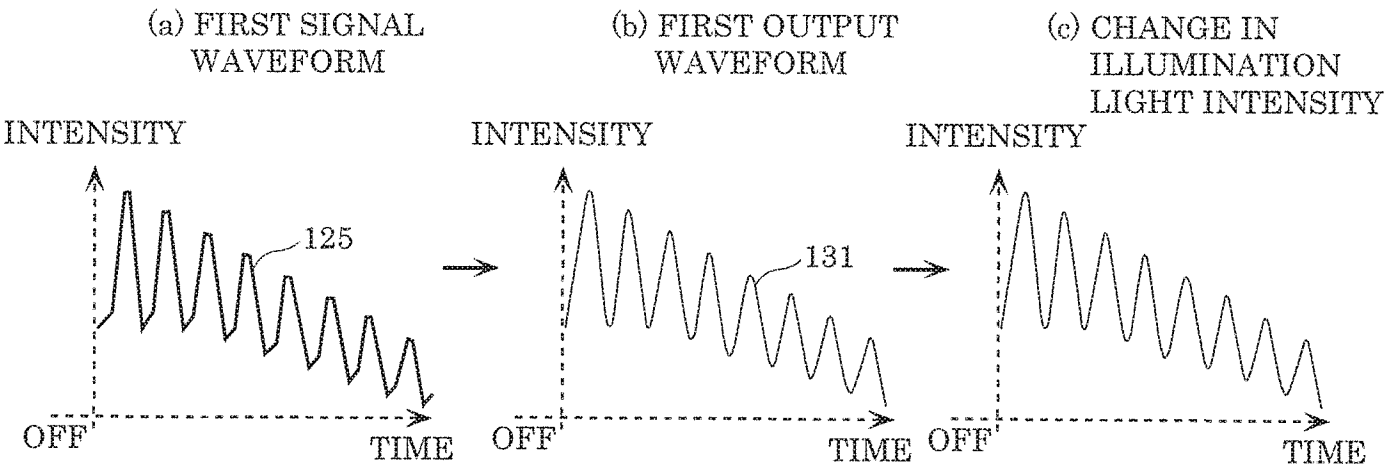
FIG. 4 illustrates input and output waveforms relative to a first filter included in a lighting controller according to Embodiment 1, and illustrates changes in illumination light intensity based on the output waveform.

FIG. 4 illustrates input and output waveforms relative to first filter 130 included in lighting controller 110 according to this embodiment, and illustrates changes in illumination light intensity based on the output waveform. As illustrated in (a) in FIG. 4, first signal waveform 125 is defined by a piecewise linear curve (first piecewise linear curve), and the intensity of first signal waveform 125 repeatedly increases and decreases. First signal waveform 125 is the waveform of a signal input into first filter 130 (i.e., an input waveform).

Since first signal waveform 125 is a piecewise linear curve, the amount of data required to be stored in storage 120 is reduced. More specifically, first signal waveform 125 includes a plurality of turning points and is formed by sequentially connecting the turning points with straight lines (line segments). Each of the turning points is expressed as a set of coordinates, one value indicating time and the other indicating signal intensity. Time is, for example, a point in time relative to (a difference in time from) the initiation of flicker mode.

Storage 120 stores, as first signal waveform 125, sets of coordinates (time, signal strength) for the turning points. In other words, there is no need to store coordinates constituting the output waveform or the slope of the output waveform; it is possible to reduce the amount of data required to form the output waveform. Accordingly, it is possible to conserve memory resources in storage 120. This also makes it possible to use a smaller capacity memory for storage 120, which is smaller in size and costs less.

First filter 130 converts first signal waveform 125 into a signal waveform defined by a smooth rounded curve, and outputs the converted signal waveform as first output waveform 131. More specifically, as illustrated in (b) in FIG. 4, first filter 130 generates and outputs first output waveform 131 by converting the straight line sections and turning points of the input first signal waveform 125 into a rounded curve. First filter 130 is embodied as a low-pass filter, such as an RC filter, moving average filter, or spline filter, but first filter 130 is not limited to this example.

Note that the filter intensity of first filter 130, that is to say, the degree of the conversion of the piecewise linear curve into a rounded curve, is not particularly limited. For example, the converted rounded curve may be a spline curve or Bézier curve.

Lighting controller 110 causes light emitter 20 to repeatedly increase and decrease the illumination light intensity in accordance with first output waveform 131 output from first filter 130. More specifically, lighting controller 110 generates a control signal based on first output waveform 131 illustrated in (b) in FIG. 4 and outputs the generated control signal to light emitter 20. As illustrated in (c) in FIG. 4, light emitter 20 emits illumination light whose intensity changes in conformity with the increases and decreases in intensity in first output waveform 131.

With this, lighting fixture 1 emits flickering illumination light whose intensity changes by smoothly increasing and decreasing in a repeated manner. Since the changes in intensity are smooth and not abrupt, this calms and relaxes user 2. For example, lighting fixture 1 causes light emitter 20 to operate in flicker mode when user 2 goes to bed. This calms user 2 and induces sleepiness, making it possible to pleasantly lull user 2 to sleep.

(Technical Advantages, Etc.)

As described above, lighting device 100 according to this embodiment includes lighting controller 110 that controls light emitter 20 that emits illumination light. Lighting controller 110 includes first filter 130 that converts first signal waveform 125 that is defined by a piecewise linear curve and whose intensity repeatedly increases and decreases into a signal waveform having a smooth rounded curve, and outputs the converted signal waveform as first output waveform 131. Lighting controller 110 causes light emitter 20 to repeatedly increase and decrease the intensity of the illumination light in accordance with first output waveform 131.

With this, since it is possible to convert a signal waveform defined by a piecewise linear curve into a signal waveform defined by a rounded curve via first filter 130, it is possible to form first output waveform 131 whose intensity smoothly increases and decreases simply by storage 120 storing just coordinates (time, intensity) for the turning points constituting the piecewise linear curve. In other words, it is possible to reduce the amount of data required to form first output waveform 131 having the rounded curve, and thus possible to conserve memory resources.

In this way, according to this embodiment, it is possible to provide lighting device 100 that can increase and decrease illumination light intensity with a simple configuration. Moreover, according to this embodiment, it is possible to provide lighting fixture 1 or electronic device 4 including lighting device 100.

Embodiment 2

Next, Embodiment 2 will be described.

In this embodiment, operations pertaining to the lighting controller differ from Embodiment 1. The following description will focus on the points of difference from Embodiment 1; description of common points will be omitted or shortened.

(Configuration)

Figure 5:
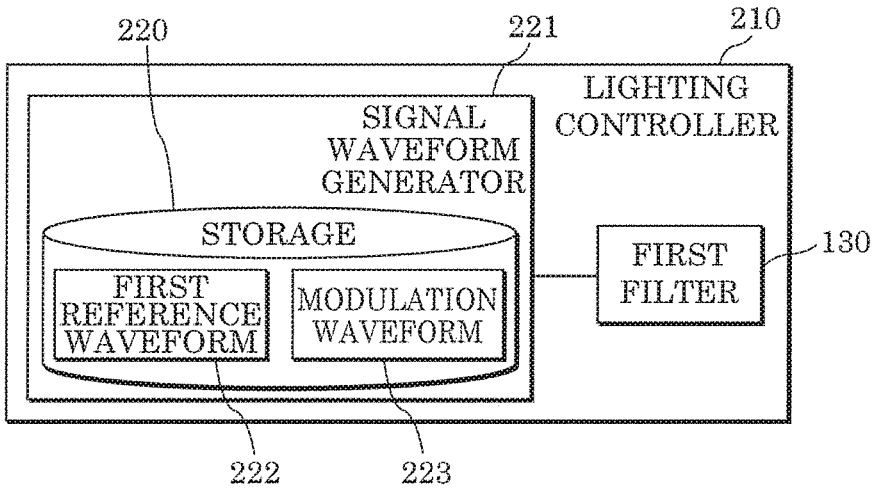
FIG. 5 illustrates a functional block diagram of the configuration of a lighting controller included in a lighting device according to Embodiment 2.

FIG. 5 illustrates a functional block diagram of the configuration of lighting controller 210 included in the lighting device according to this embodiment. As illustrated in FIG. 5, lighting controller 210 includes signal waveform generator 221 and first filter 130.

Signal waveform generator 221 generates a first signal waveform by repeatedly superimposing modulation waveform 223 onto first reference waveform 222 and outputs the generated first signal waveform to first filter 130. Signal waveform generator 221 includes storage 220 that stores first reference waveform 222 and modulation waveform 223. First reference waveform 222 and modulation waveform 223 are each represented as a graph with time on the horizontal axis and intensity on the vertical axis.

Figure 6:
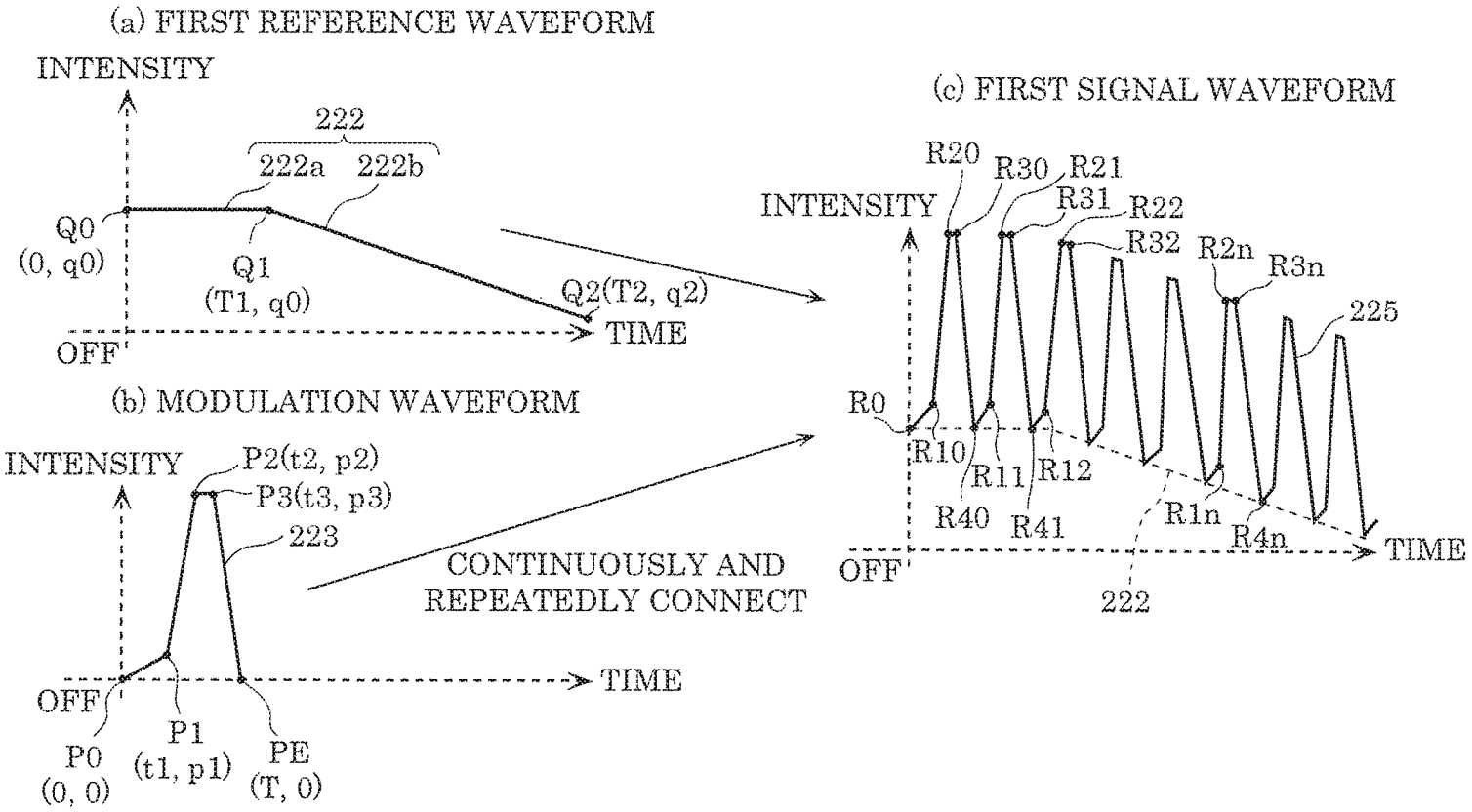
FIG. 6 illustrates operations performed by a signal waveform generator included in a lighting controller according to Embodiment 2.

FIG. 6 illustrates operations performed by signal waveform generator 221 according to this embodiment. In FIG. 6, (*a*) through (*c*) illustrate first reference waveform 222, modulation waveform 223, and first signal waveform 225, respectively.

As illustrated in (a) in FIG. 6, first reference waveform 222 is defined by a piecewise linear curve (second piecewise linear curve). More specifically, first reference waveform 222 includes start point Q0, turning point Q1, and end point Q2. First reference waveform 222 includes constant section 222*a* where the intensity remains constant and decreasing section 222*b* where the intensity decreases at a constant rate. Constant section 222*a* is a line segment that connects start point Q0 and turning point Q1. Decreasing section 222*b* is a line segment that connects turning point Q1 and end point Q2.

First reference waveform 222 is a representation of a monotonically decreasing function. In other words, the intensity in first reference waveform 222 does not increase over time. More specifically, in first reference waveform 222, the intensity is highest at start point Q0 and does not exceed that intensity thereafter. For example, when the coordinates (time, intensity) for start point Q0 are (0, q0), the peak intensity of first reference waveform 222 is q0.

When the length (time) of constant section 222*a* is expressed as T1, the coordinates for turning point Q1 are expressed as (T1, q0). When the length (time) of first reference waveform 222 is expressed as T2, the coordinates for end point Q2 are expressed as (T2, q2). In this embodiment, constant section 222*a* is longer than length T of modulation waveform 223. Intensity q2 of end point Q2 may be 0.

Note that in place of constant section 222*a*, first reference waveform 222 may include a decreasing section that decreases at a different rate from decreasing section 222*b*. In other words, first reference waveform 222 may include a plurality of decreasing sections that decrease at different rates. Alternatively, first reference waveform 222 may be defined by a single straight line (first single straight line). For example, first reference waveform 222 may be composed of only decreasing section 222*b*.

As illustrated in (b) in FIG. 6, modulation waveform 223 is defined by a piecewise linear curve (third piecewise linear curve) whose peak is between start point P0 and end point PE. In this embodiment, modulation waveform 223 includes at least two points, including its peak, between start point P0 and end point PE. More specifically, as illustrated in (b) in FIG. 6, modulation waveform 223 includes three points P1 through P3 between start point P0 and end point PE.

Here, the coordinates for start point P0, end point PE, and points P1 through P3 of modulation waveform 223 are P0 (0, 0), PE (T, 0), P1 (t1, p1), P2 (t2, p2), and P3 (t3, p3), respectively. Note that time T of end point PE corresponds to the repeating period (cycle) of modulation waveform 223. In this embodiment, 0<t1<t2<t3<T and 0<p1<p2<p3.

As illustrated in (b) in FIG. 6, the peak is point P3. Point P1 is located between start point P0 and the peak point P3. The intensity of point P1 is less than half the intensity of the peak. In other words, p1<p3/2.

In this embodiment, first reference waveform 222 is a waveform that defines the minimum value of each repetition of modulation waveform 223. In other words, in each repetition of modulation waveform 223, start point P0 and end point PE are positioned on first reference waveform 222. More specifically, when repeatedly superimposing modulation waveform 223 onto first reference waveform 222, signal waveform generator 221 positions start point P0 and end point PE of each repetition of modulation waveform 223 on the single straight line or the piecewise linear curve defining first reference waveform 222 and positions start point P0 of each repetition of modulation waveform 223 at end point PE of the immediately preceding repetition. With this, signal waveform generator 221 generates, for example, first signal waveform 225 illustrated in (c) in FIG. 6, and outputs first signal waveform 225 to first filter 130.

In this embodiment, signal waveform generator 221 generates first signal waveform 225 by continuously and repeatedly adding a plurality of modulation waveforms 223 to first reference waveform 222. Signal waveform generator 221 generates first signal waveform 225 by determining the turning points (points) of first signal waveform 225, which is a piecewise linear curve. As illustrated in (c) in FIG. 6, the turning points of first signal waveform 225 include start point R0 and points R1*n* through R4*n* of each repetition (n is the number of repetitions).

Start point R0 of first signal waveform 225 is expressed as the sum of start point Q0 of first reference waveform 222 and start point P0 of modulation waveform 223. In this embodiment, the coordinates for start point P0 of modulation waveform 223 are (0, 0). As such, the coordinates for start point R0 match the coordinates for Q0: (0, q0).

Next, signal waveform generator 221 determines points R10 through R40. For example, the time coordinate for point R10 is t1, which the sum of the time coordinate (0) for start point Q0 and the time coordinate (t1) for point P1. The intensity coordinate for point P1 is the sum of the intensity of the point of first reference waveform 222 located at time t1 and the intensity (p1) of point P1 of modulation waveform 223. Note that time t1 is positioned on constant section 222*a* included in first reference waveform 222, and as such, the intensity of the point of first reference waveform 222 at time t1 is q0, which is the same as at start point Q0. Accordingly, the coordinates for point R10 are (t1, q0+p1). Similarly, for subsequent points R20 through R40, the coordinates are (t2, q0+p2), (t3, q0+p3), and (T, q0), respectively.

Signal waveform generator 221 repeatedly superimposes modulation waveform 223 onto first reference waveform 222 (more specifically, repeatedly adds modulation waveform 223 to first reference waveform 222). For example, signal waveform generator 221 positions point R40, which corresponds to end point PE of modulation waveform 223, at start point P0 of the subsequent modulation waveform 223, and determines points R11 through R41 corresponding to points P1 through P3 and end point PE. For example, the coordinates for points R11 through R41 are (T+t1, q0+p1), (T+t2, q0+p2), (T+t3, q0+p3), and (2T, q0), respectively.

The above example is for when modulation waveform 223 is added to constant section 222*a* of first reference waveform 222, but the same applies for when modulation waveform 223 is added to decreasing section 222*b*. More specifically, signal waveform generator 221 may calculate the intensities of decreasing section 222*b* at times corresponding to points P1 through P3 of modulation waveform 223 and add the calculated intensities and the intensities at points P1 through P3 of modulation waveform 223 together.

First signal waveform 225 defined by a piecewise linear curve such as illustrated in (c) in FIG. 6 is generated as a result of repeatedly superimposing modulation waveform 223. In first signal waveform 225 according to this embodiment, the difference between the start point and peak of each repetition of increase and decrease in intensity (i.e., the magnitude of the increase and decrease) is approximately equal across the repetitions, and more specifically, corresponds to the peak intensity (p3) of modulation waveform 223.

(Technical Advantages, Etc.)

As described above, in the lighting fixture according to this embodiment, for example, lighting controller 210 further includes signal waveform generator 221 that generates first signal waveform 225 by repeatedly superimposing modulation waveform 223 onto first reference waveform 222 and outputs first signal waveform 225 to first filter 130. First reference waveform 222 is defined by a single straight line or a piecewise linear curve. Modulation waveform 223 is a piecewise linear waveform having start point P0, end point PE, and a peak between start point P0 and end point PE.

With this, since first signal waveform 225 is generated based on first reference waveform 222 and modulation waveform 223, it is possible to reduce the amount of data required to be stored. In other words, coordinates for each turning point of first signal waveform 225 need not be stored; first signal waveform 225 can be generated even when only the coordinates for each point of first reference waveform 222 and modulation waveform 223 are stored.

For example, first reference waveform 222 can be configured of three sets of coordinates for start point Q0, turning point Q1, and end point Q2, and modulation waveform 223 can be configured of five sets of coordinates for start point P0, end point PE, and points P1 through P3. It is possible to generate first signal waveform 225 whose intensity repeatedly increases and decreases while gradually decreasing over time, even when only these 8 sets of coordinates are stored.

Note that the slope and length of each segment in the piecewise linear curves of first reference waveform 222 and modulation waveform 223 may be stored instead of coordinates.

Moreover, for example, modulation waveform 223 is defined by a piecewise linear waveform having at least two points, including the peak, between start point P0 and end point PE (in this example, points P1 through P3).

With this, it is possible to form various piecewise linear waveforms by adjusting the coordinates for the at least two points. Although the amount of data required to be stored increases as the number of points increase, data can be prevented from bloating since only coordinate values need be stored. In this way, it is possible to prevent data bloating and also fine tune the increases and decreases in illumination light intensity.

For example, the at least two points include point P1 between start point P0 and the peak (point P3) at an intensity that is less than half the intensity of the peak. Similarly, the at least two points may include a point between the peak (point P3) and end point PE at an intensity that is less than half the intensity of the peak.

With this, since point P1 at a low intensity is present before or after the peak, it is possible to provide a gentle increase or decrease in intensity. Accordingly, when increases and decreases in illumination light intensity are repeated, the increases or decreases are gentle, and as a result, the illumination light appears "soft" to user 2, imparting a sense of security. This further calms user 2 and induces sleepiness, making it possible to smoothly and pleasantly lull user 2 to sleep.

Moreover, for example, first reference waveform 222 is a representation of a monotonically decreasing function.

With this, it is possible to gradually decrease illumination light intensity.

Moreover, for example, when repeatedly superimposing modulation waveform 223 onto first reference waveform 222, lighting controller 210 positions start point P0 and end point PE of each repetition of modulation waveform 223 on the single straight line or the piecewise linear curve defining first reference waveform 222 and positions start point P0 of each repetition of modulation waveform 223 at end point PE of the immediately preceding repetition.

With this, the minimum value of each repetition of the increase and decrease of illumination light intensity changes along first reference waveform 222. Accordingly, by appropriately designing the shape of first reference waveform 222, the minimum value for the illumination light flicker (the darkest brightness level per flicker) can be adjusted to a desired brightness. Note that in the present description, "per flicker" means "per repetition of increase and decrease in intensity". Accordingly, one flicker means one repetition, i.e., one flicker corresponds to one modulation waveform 223.

Embodiment 3

Next, Embodiment 3 will be described.

In this embodiment, operations pertaining to the lighting controller differ from Embodiment 2. The following description will focus on the points of difference from Embodiment 2; description of common points will be omitted or shortened.

(Configuration)

Figure 7:
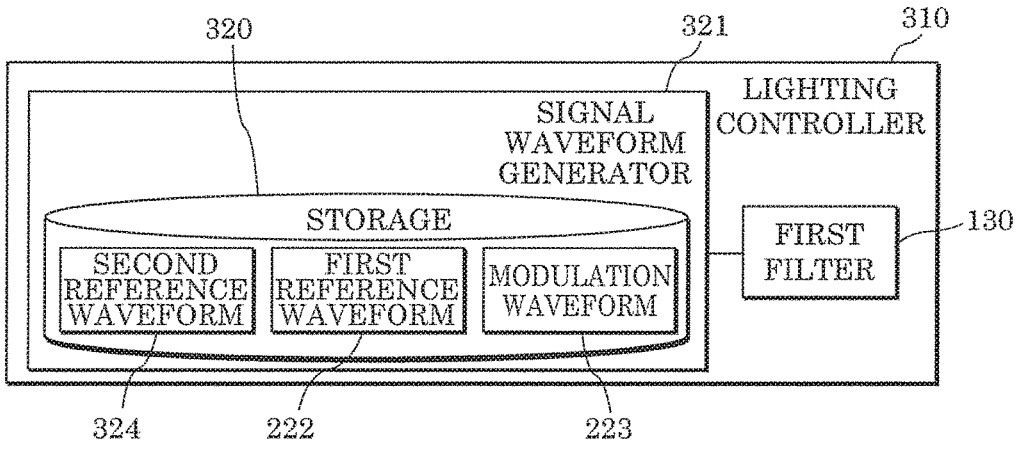
FIG. 7 illustrates a functional block diagram of the configuration of a lighting controller included in a lighting device according to Embodiment 3.

FIG. 7 illustrates a functional block diagram of the configuration of lighting controller 310 included in the lighting device according to this embodiment. As illustrated in FIG. 7, lighting controller 310 includes signal waveform generator 321 and first filter 130.

Signal waveform generator 321 generates first signal waveform 325 (see FIG. 8) by repeatedly superimposing modulation waveform 223 onto first reference waveform 222 and second reference waveform 324 and outputs the generated first signal waveform 325 to first filter 130. Signal waveform generator 321 includes storage 320 that stores first reference waveform 222, modulation waveform 223, and second reference waveform 324. First reference waveform 222, second reference waveform 324, and modulation waveform 223 are each represented as a graph with time on the horizontal axis and intensity on the vertical axis.

Figure 8:
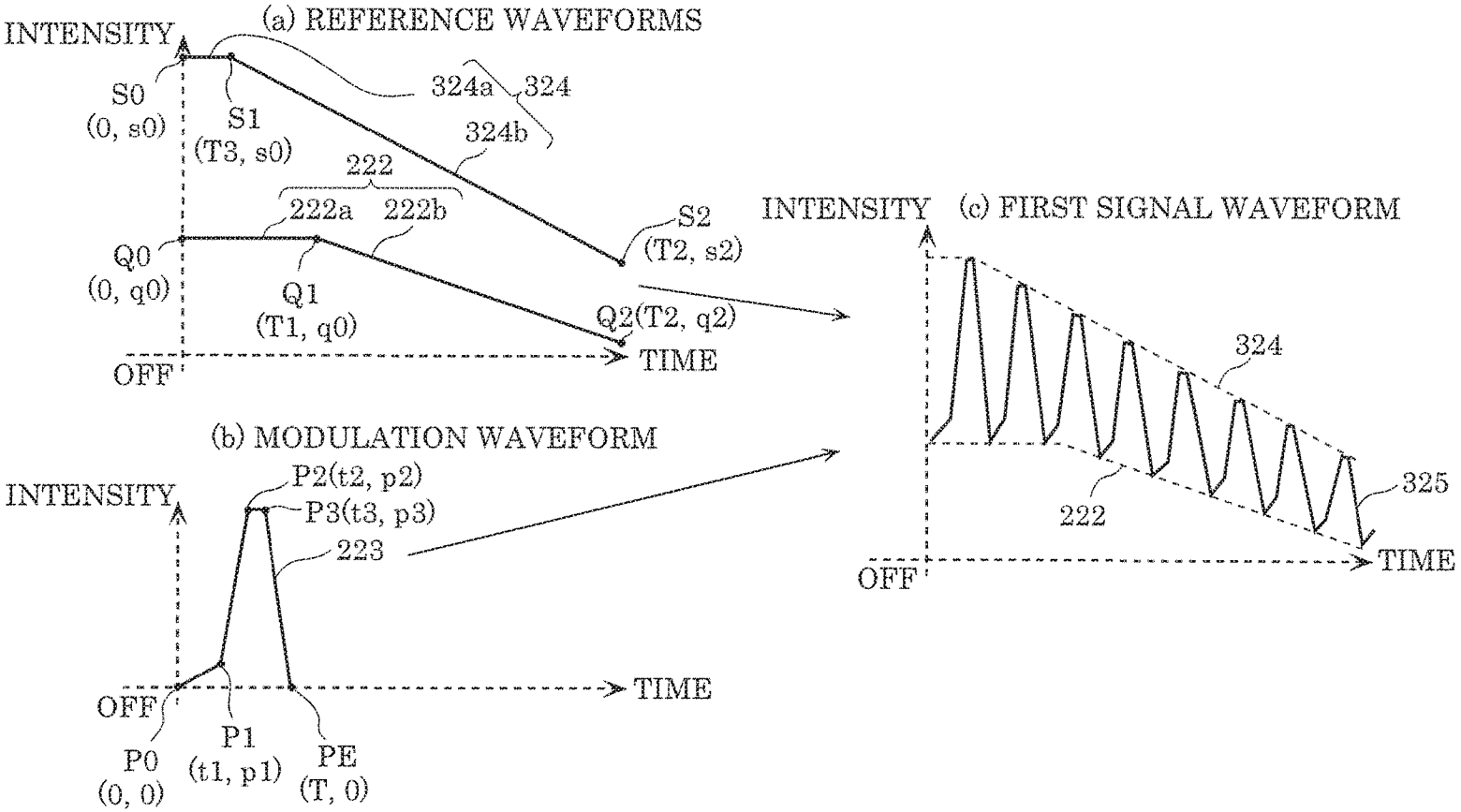
FIG. 8 illustrates one example of operations performed by a signal waveform generator included in a lighting controller according to Embodiment 3.

FIG. 8 illustrates one example of operations performed by signal waveform generator 321 according to this embodiment. In FIG. 8, (*a*) through (*c*) illustrate first reference waveform 222 and second reference waveform 324; modulation waveform 223; and first signal waveform 325, respectively. As illustrated in (a) and (b) in FIG. 8, first reference waveform 222 and modulation waveform 223 are the same as in Embodiment 2.

As illustrated in (a) in FIG. 8, second reference waveform 324 is defined by a piecewise linear curve (fourth piecewise linear curve). More specifically, second reference waveform 324 includes start point S0, turning point S1, and end point S2. Second reference waveform 324 includes constant section 324*a* where the intensity remains constant and decreasing section 324*b* where the intensity decreases at a constant rate. Constant section 324*a* is a line segment that connects start point S0 and turning point S1. Decreasing section 324*b* is a line segment that connects turning point S1 and end point S2.

Second reference waveform 324 is a representation of a monotonically decreasing function. In other words, the intensity in second reference waveform 324 does not increase over time. More specifically, in second reference waveform 324, the intensity is highest at start point S0 and does not exceed that intensity thereafter. For example, when the coordinates (time, intensity) for start point S0 are (0, s0), the peak intensity of second reference waveform 324 is s0.

When the length (time) of constant section 324*a* is expressed as T3, the coordinates for turning point S1 are expressed as (T3, s0). Constant section 324*a* is shorter than constant section 222*a* of first reference waveform 222. In other words, T3<T1, but this example is not limiting. Constant section 324*a* and constant section 222*a* may be equal in length. Alternatively, constant section 324*a* may be longer than constant section 222*a*. In other words, T3>T1 may hold true.

Decreasing section 324*b* has a steeper slope (higher rate of decrease) than decreasing section 222*b* of first reference waveform 222, but decreasing section 324*b* is not limited to this example. Decreasing section 324*b* and decreasing section 222*b* may have the same slope. Alternatively, decreasing section 324*b* may slope more gently than decreasing section 222*b*. When the length (time) of second reference waveform 324 is expressed as T2, the coordinates for end point S2 are expressed as (T2, s2). Here, intensity s2 of end point S2 may be 0.

In this embodiment, first reference waveform 222 and second reference waveform 324 do not cross paths midway; the intensity of second reference waveform 324 is greater than first reference waveform 222 at all times. End point Q2 of first reference waveform 222 and end point S2 of second reference waveform 324 may overlap.

Note that in place of constant section 324*a*, second reference waveform 324 may include a decreasing section that decreases at a different rate from decreasing section 324*b*. In other words, second reference waveform 324 may include a plurality of decreasing sections that decrease at different rates. Alternatively, second reference waveform 324 may be defined by a single straight line (second single straight line). For example, second reference waveform 324 may be composed of only decreasing section 324*b*.

In this embodiment, second reference waveform 324 is a waveform that defines the position of the peak of each repetition of modulation waveform 223. In other words, in each repetition of modulation waveform 223, the peak (point P3) is positioned on second reference waveform 324. More specifically, when repeatedly superimposing modulation waveform 223 onto first reference waveform 222, signal waveform generator 321 positions the peak of each repetition of modulation waveform 223 on the single straight line or piecewise linear curve defining second reference waveform 324. With this, signal waveform generator 321 generates, for example, first signal waveform 325 illustrated in (c) in FIG. 8, and outputs first signal waveform 325 to first filter 130.

Here, similar to Embodiment 2, first reference waveform 222 is a waveform that defines the positions of start point P0 and end point PE of each repetition of modulation waveform 223. Accordingly, first reference waveform 222 and second reference waveform 324 define the peak-to-peak height of the increase and decrease in intensity in each repetition of modulation waveform 223. As illustrated in (a) in FIG. 8, since first reference waveform 222 and second reference waveform 324 follow converging paths in the direction of the elapse of time, in first signal waveform 325, the peak-to-peak height of the increases and decreases in intensity gradually decreases, as illustrated in (c) in FIG. 8.

In this embodiment, signal waveform generator 321 generates first signal waveform 325 by continuously and repeatedly adding, to first reference waveform 222, a product obtained by multiplying second reference waveform 324 with a plurality of modulation waveforms 223. More specifically, signal waveform generator 321 generates first signal waveform 325 by multiplying a ratio of the peak-to-peak height of first reference waveform 222 and the peak-to-peak height of second reference waveform 324 (initial value of peak-to-peak height is 1) with the intensity values of the points of modulation waveform 223 excluding start point P0 and end point PE (i.e., points P1 through P3).

(Technical Advantages, Etc.)

As described above, with the lighting device according to this embodiment, for example, when repeatedly superimposing modulation waveform 223 onto first reference waveform 222, lighting controller 310 positions the peak of each repetition of modulation waveform 223 on the single straight line or piecewise linear curve defining second reference waveform 324.

With this, the maximum value of each repetition of the increase and decrease of illumination light intensity changes along second reference waveform 324. Accordingly, by appropriately designing the shape of second reference waveform 324, the maximum value for the illumination light flicker (the brightest brightness level per flicker) can be adjusted to a desired brightness.

Moreover, for example, second reference waveform 324 includes a section whose rate of decrease is greater than the rate of decrease of first reference waveform 222.

With this, it is possible to gradually decrease the peak-to-peak height of the increases and decreases in illumination light intensity. For example, since it is possible to repeatedly switch between bright and dark states while gradually reducing the brightness over time, it possible to smoothly and pleasantly lull user 2 to sleep.

Variation

Next, a variation of this embodiment will be described.

In this embodiment, second reference waveform 324 and first reference waveform 222 were exemplified as having different shapes, but second reference waveform 324 and first reference waveform 222 may have the same shape.

Figure 9:
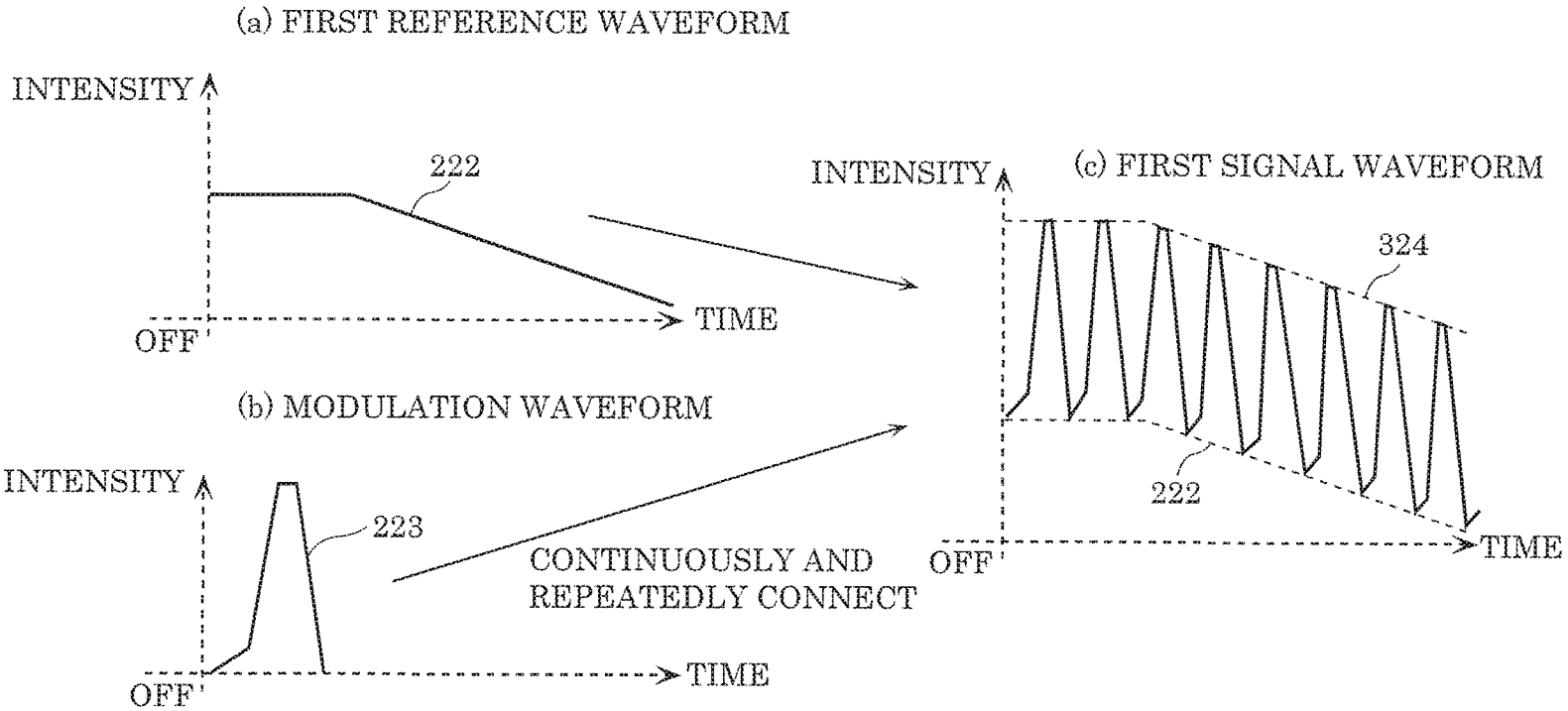
FIG. 9 illustrates another example of operations performed by a signal waveform generator included in a lighting controller according to Embodiment 3.

FIG. 9 illustrates another example of operations performed by signal waveform generator 321 according to this variation. As illustrated in (a) and (b) in FIG. 9, first reference waveform 222 and modulation waveform 233 are the same as in Embodiment 3.

In this variation, as illustrated in (c) in FIG. 9, second reference waveform 324, which is a waveform that defines the position of the peak of each repetition of modulation waveform 223, has the same shape as first reference waveform 222.

Accordingly, with the lighting device according to this variation, for example, first reference waveform 222 and second reference waveform 324 have the same shape.

With this, it is possible to gradually decrease brightness overall while maintaining the peak-to-peak height of the increases and decreases in illumination light intensity at an approximately constant value.

Embodiment 4

Next, Embodiment 4 will be described.

This embodiment differs from Embodiment 3 in that the light emitter includes a plurality of light sources and the color of the illumination light can be changed. The following description will focus on the points of difference from Embodiment 3; description of common points will be omitted or shortened.

(Configuration)

Figure 10:
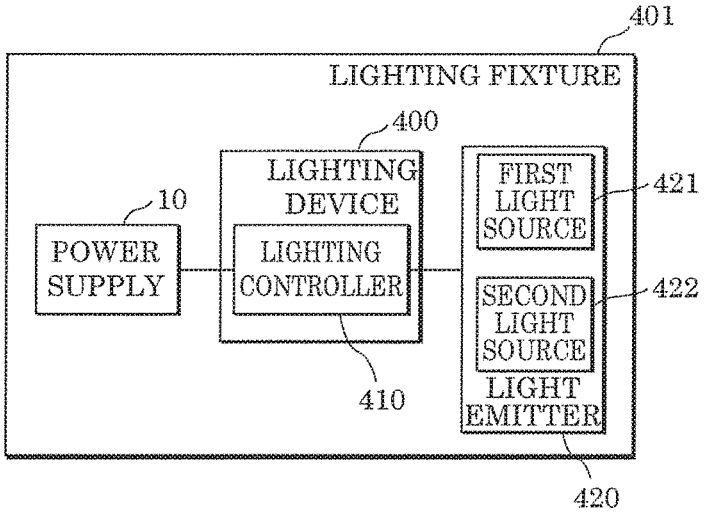
FIG. 10 illustrates a functional block diagram of the configuration of a lighting fixture including a lighting device according to Embodiment 4.

FIG. 10 illustrates a functional block diagram of the configuration of lighting fixture 401 including lighting device 400 according to this embodiment. As illustrated in FIG. 10, lighting fixture 401 includes power supply 10, lighting device 400, and light emitter 420.

Light emitter 420 includes first light source 421 and second light source 422. The illumination light emitted by light emitter 420 is a mix of light emitted by first light source 421 and light emitted by second light source 422.

First light source 421 and second light source 422 emit light of mutually different colors. More specifically, the light emitted by first light source 421 and the light emitted by second light source 422 differ in color temperature. More specifically, second light source 422 emits light that is higher in color temperature than the light emitted by first light source 421. The color temperature of the light emitted by first light source 421 is, for example, less than or equal to 3000 K, and in one example, is 2000 K. The color temperature of the light emitted by second light source 422 is, for example, greater than or equal to 5000 K, and in one example, is 6500 K.

In this embodiment, at least one of first light source 421 or second light source 422 is equipped with a dimming function. More specifically, at least one of first light source 421 or second light source 422 can change the intensity of light (amount of light output) based on a control signal from lighting device 400. The intensity and color (more specifically, color temperature) of the illumination light emitted by light emitter 420 varies depending on the combination of the amounts of light output by first light source 421 and second light source 422.

Figure 11:
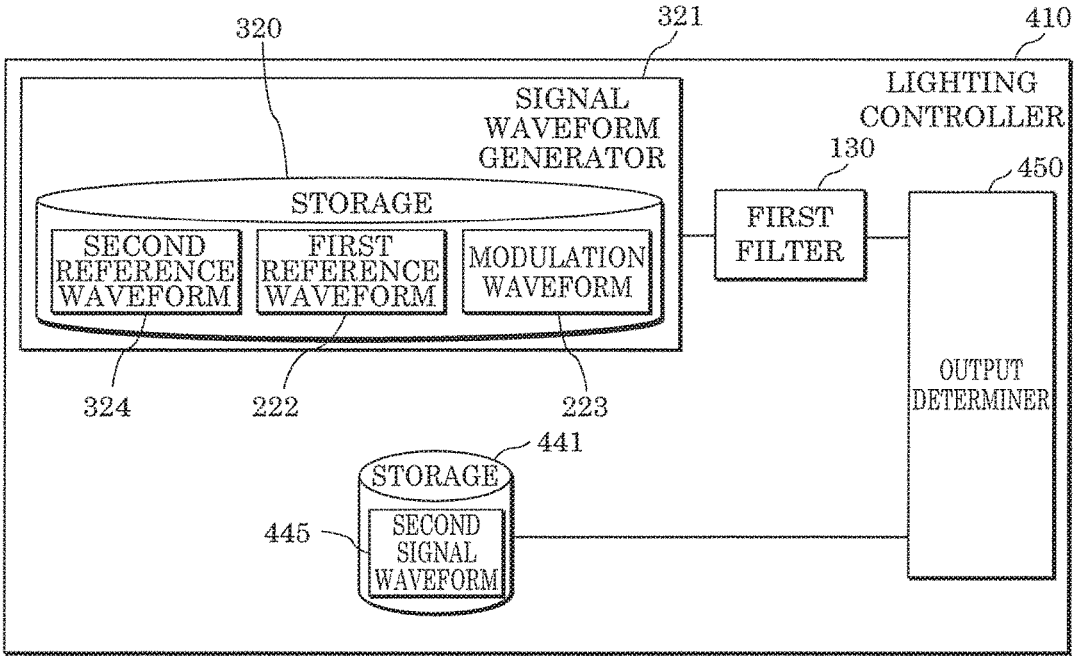
FIG. 11 illustrates a functional block diagram of one example of the configuration of a lighting controller included in a lighting device according to Embodiment 4.

Lighting device 400 includes lighting controller 410. FIG. 11 illustrates a functional block diagram of the configuration of lighting controller 410 included in lighting device 400 according to this embodiment.

As illustrated in FIG. 11, unlike lighting controller 310 according to Embodiment 3, which is illustrated in FIG. 7, lighting controller 410 includes storage 441 and output determiner 450.

Second signal waveform 445 is stored in storage 441. Second signal waveform 445 is defined by a single straight line or a piecewise linear curve (second piecewise linear curve). Second signal waveform 445 indicates the relationship between an intensity value of the first output waveform and a color temperature of the illumination light. A specific example of second signal waveform 445 will be given later.

Output determiner 450 determines an intensity at which light is to be emitted by first light source 421 and an intensity at which light is to be emitted by second light source 422 based on first output waveform 131 and second signal waveform 445. In this embodiment, based on second signal waveform 445, output determiner 450 determines a color temperature for the illumination light to be emitted by light emitter 420 from an intensity value of first output waveform 131, and determines light intensities for first light source 421 and second light source 422 that give the illumination light emitted by light emitter 420 the determined color temperature.

Lighting controller 410 causes first light source 421 and second light source 422 to emit light at the intensities determined by output determiner 450. With this, the illumination light emitted by light emitter 420 repeatedly increases and decreases in intensity in accordance with first output waveform 131 and changes in color temperature. In this embodiment, lighting controller 410 causes light emitter 420 to start changing the color temperature of the illumination light at the start point of the repeating of the increases and decreases in the intensity of the illumination light. More specifically, lighting controller 410 starts changing the color temperature at the same time the flicker mode is implemented. In other words, both the intensity and the color temperature of illumination light change in flicker mode.

SPECIFIC EXAMPLES

Hereinafter, examples of the second signal waveform and illumination light will be given.

(Relative Change)

First, an example in which color temperature is changed in accordance with a relative increase and decrease in intensity within a cycle will be given with reference to FIG. 12A and FIG. 12B. More specifically, in a cycle of the repeating increases and decreases in the intensity of the illumination light, lighting controller 410 causes light emitter 420 to change the color temperature of the illumination light in accordance with a relative increase and decrease in intensity within the cycle. The relative increase and decrease in intensity within a cycle are generated by repeatedly superimposing modulation waveform 223. In other words, based on second signal waveform 445*a*, lighting controller 410 changes the color temperature of the illumination light per repetition of modulation waveform 223 in accordance with the increases and decreases in intensity of modulation waveform 223.

Figure 12A:
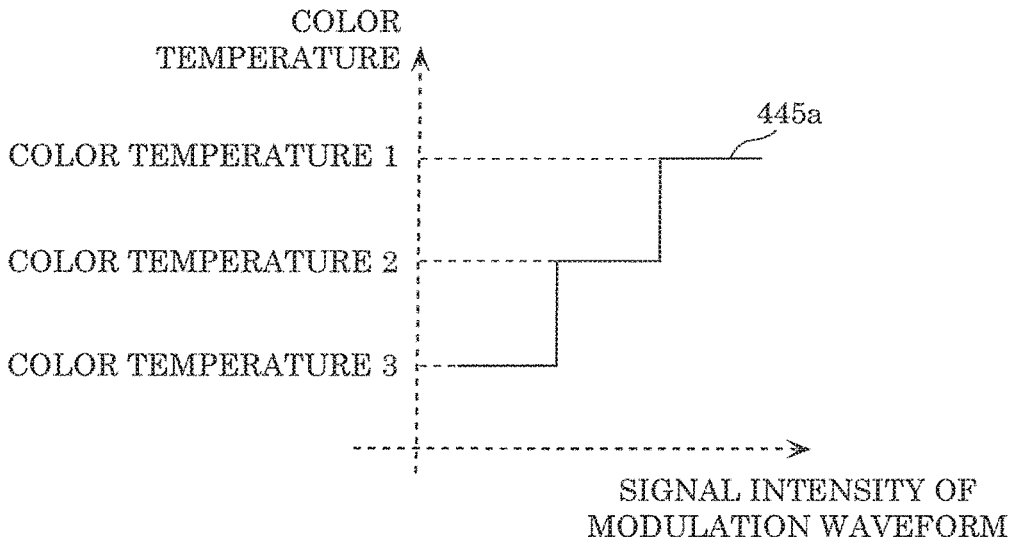
FIG. 12A illustrates one example of a second signal waveform according to Embodiment 4.

FIG. 12A illustrates second signal waveform 445*a*, which is one example of second signal waveform 445 according to this embodiment. In FIG. 12A, modulation waveform 223 signal intensity is represented on the horizontal axis and color temperature is represented on the vertical axis. As illustrated in FIG. 12A, second signal waveform 445*a* is defined by piecewise linear curve that changes in steps. Second signal waveform 445*a* indicates that the color temperature changes in three steps in accordance with the signal intensity of modulation waveform 223.

Figure 12B:
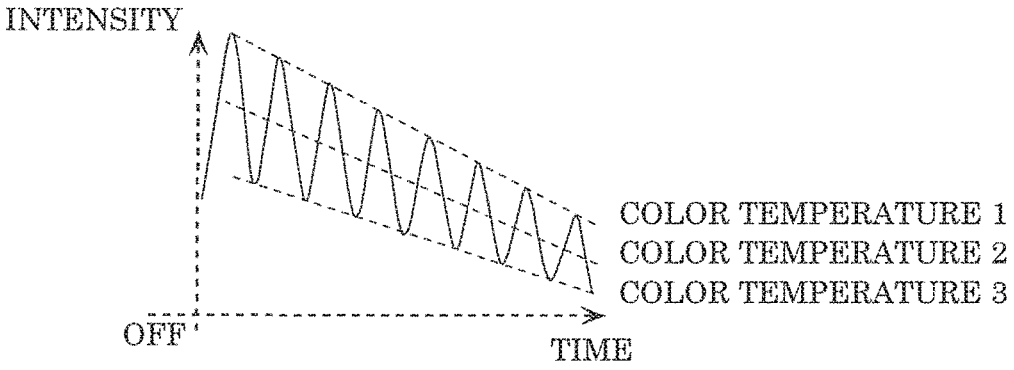
FIG. 12B illustrates one example of illumination light based on the second signal waveform illustrated in FIG. 12A.

FIG. 12B illustrates one example of illumination light based on second signal waveform 445*a* illustrated in FIG. 12A. As illustrated in FIG. 12B, changes in color temperature conform with the increases and decreases in illumination light intensity. More specifically, each time the illumination light intensity weakens, the color temperature decreases, and each time the illumination light intensity strengthens, the color temperature increases. In other words, the color temperature of the illumination light also repeatedly increases and decreases in conformity with the increases and decreases in illumination light intensity.

(Absolute Change)

The color temperature may be changed in accordance with an absolute value of the illumination light intensity. More specifically, lighting controller 410 controls light emitter 420 such that the color temperature of the illumination light changes in accordance with an absolute value of the illumination light intensity.

Figure 13A:
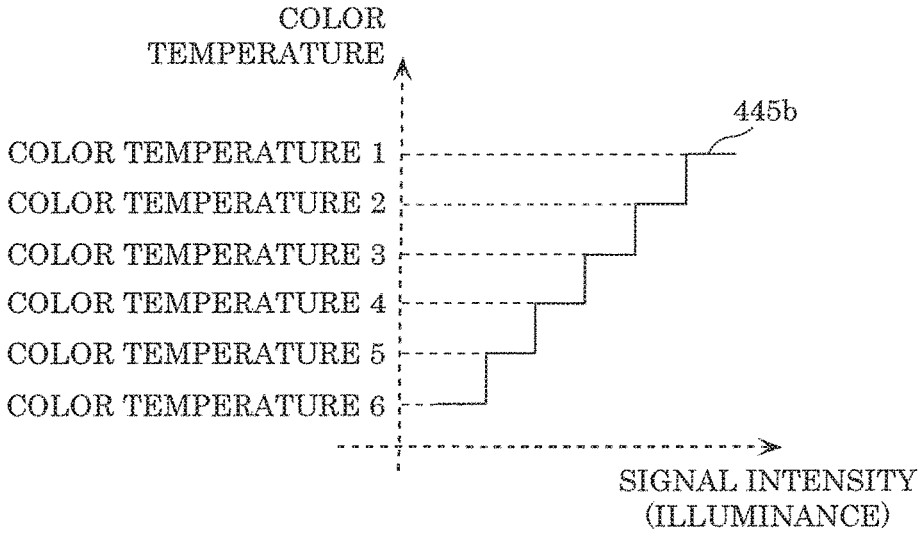
FIG. 13A illustrates another example of a second signal waveform according to Embodiment 4.

FIG. 13A illustrates second signal waveform 445*b*, which is another example of second signal waveform 445 according to this embodiment. In FIG. 13A, first output waveform 131 signal intensity (i.e., illumination light intensity) is represented on the horizontal axis and color temperature is represented on the vertical axis. As illustrated in FIG. 13A, second signal waveform 445*b* is defined by a piecewise linear curve that changes in steps. Second signal waveform 445*b* indicates that the color temperature changes in six steps in accordance with the signal intensity of first output waveform 131.

Figure 13B:
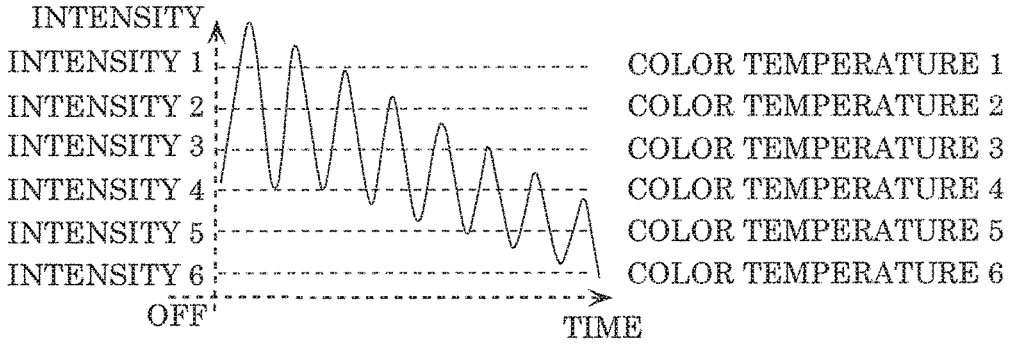
FIG. 13B illustrates one example of illumination light based on the second signal waveform illustrated in FIG. 13A.

FIG. 13B illustrates one example of illumination light based on second signal waveform 445*b* illustrated in FIG. 13A. As illustrated in FIG. 13B, changes in color temperature conform with the increases and decreases in illumination light intensity. More specifically, the color temperature changes to a color temperature dependent on an absolute value of the illumination light intensity. Accordingly, taking "color temperature 3" for example, toward the beginning, the color temperature of the illumination light when the intensity of the illumination light is low is "color temperature 3", but after some time elapses, the color temperature of the illumination light when the intensity of the illumination light is high is "color temperature 3". Some time further, the color temperature of the illumination light ceases reaching "color temperature 3".

Note that the dashed lines in FIG. 12B and FIG. 13B indicate thresholds at which the color temperature changes. Each time the intensity of the illumination light crosses a dashed line, the color temperature of the illumination light changes to the color temperature corresponding to the crossed dashed line (specifically, color temperatures 1 through 3 or color temperatures 1 through 6). In other words, in the examples illustrated in FIG. 12B and FIG. 13B, color temperature changes in steps. This is due to the piecewise linear curve defining second signal waveform 445 changing in steps, as illustrated in FIG. 12A and FIG. 13A.

(Technical Advantages, Etc.)

As described above, in lighting device 400 according to this embodiment, for example, light emitter 420 includes first light source 421 and second light source 422 that emit light of mutually different colors. Lighting controller 410 further includes output determiner 450 that determines an intensity at which light is to be emitted by first light source 421 and an intensity at which light is to be emitted by second light source 422 based on first output waveform 131 and second signal waveform 425 defined by a single straight line or a piecewise linear curve. Lighting controller 410 repeatedly increases and decreases the intensity of the illumination light in accordance with first output waveform 131 and changes the color of the illumination light, by causing first light source 421 and second light source 422 to emit light at the intensities determined by output determiner 450.

With this, it is possible to change the color (color temperature) of the illumination light in addition to the intensity of the illumination light. Accordingly, for example, by changing the shade of color of the illumination light, it is possible to increase the relaxing effect of the illumination light and pleasantly lull user 2 to sleep.

Moreover, for example, lighting controller 410 causes light emitter 420 to start changing the color of the illumination light from a start point of the repeating of the increases and the decreases in the intensity of the illumination light.

With this, it is possible to smoothly and pleasantly lull user 2 to sleep since it is possible to change the color of the illumination light in conjunction with the initiation of the flicker mode.

Moreover, for example, in a cycle of the repeating increases and decreases in the intensity of the illumination light, lighting controller 410 causes light emitter 420 to change the color of the illumination light in accordance with a relative increase and decrease in the intensity within the cycle.

With this, it is possible to smoothly and pleasantly lull user 2 to sleep since it is possible to change the color of the illumination light at a constant rate per flicker.

Moreover, for example, lighting controller 410 causes light emitter 420 to change the color of the illumination light in accordance with an absolute value of the intensity of the illumination light.

With this, it is possible to match the same color shade with the same level of brightness since the color of the illumination light changes in accordance with an absolute value of the illumination light intensity.

Variation 1

Next, Variation 1 of Embodiment 4 will be described.

Figure 14:
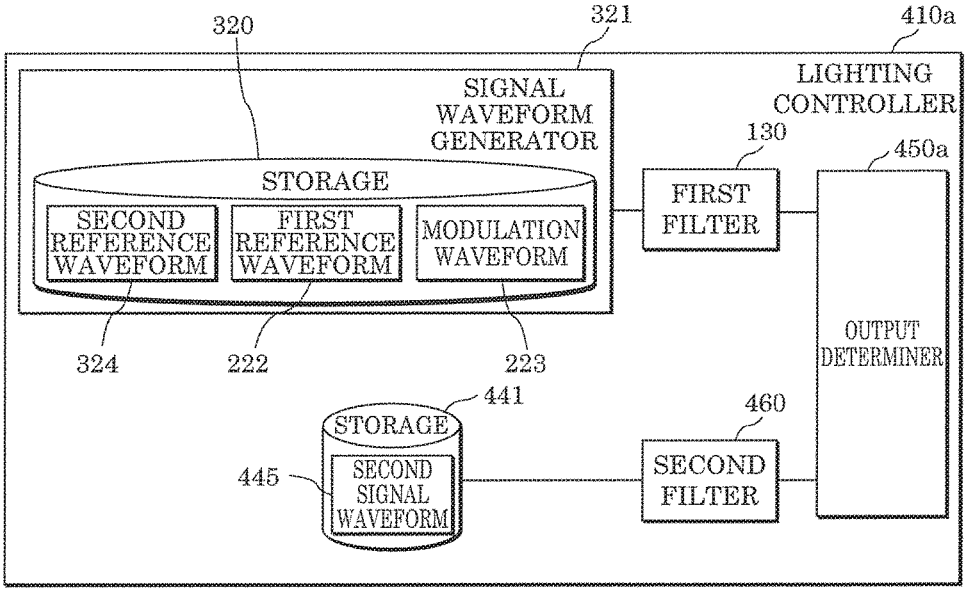
FIG. 14 illustrates a functional block diagram of the configuration of a lighting controller included in a lighting device according to Variation 1 of Embodiment 4.

FIG. 14 illustrates a functional block diagram of the configuration of lighting controller 410*a* according to this variation. As illustrated in FIG. 14, lighting controller 410*a* according to this variation differs from lighting controller 410 according to Embodiment 4, which is illustrated in FIG. 11 in that it further includes second filter 460 and includes output determiner 450*a* in place of output determiner 450.

Second filter 460 converts second signal waveform 445 into a signal waveform defined by a smooth rounded curve, and outputs the converted signal waveform as a second output waveform. For example, second filter 460 is the same type of filter as first filter 130.

Output determiner 450*a* determines an intensity at which light is to be emitted by first light source 421 and an intensity at which light is to be emitted by second light source 422 based on the first output waveform and the second output waveform. In other words, output determiner 450*a* smoothly changes (i.e., continuously changes) the intensity of the illumination light based on the first output waveform and smoothly changes (i.e., continuously changes) the color temperature of the illumination light in accordance with the intensity, based on the second output waveform.

Second signal waveform 445 is converted to a waveform defined by a smooth rounded curve by passing through second filter 460. For example, as a result of second signal waveform 445*a* illustrated in FIG. 12A being converted to a waveform defined by a smooth rounded curve, the color temperature smoothly changes in accordance with the signal intensity of the modulation waveform. Similarly, as a result of second signal waveform 445*b* illustrated in FIG. 13A being converted to a waveform defined by a smooth rounded curve, the color temperature of the illumination light smoothly changes in accordance with an absolute value of the intensity of the illumination light.

As described above, with the lighting device according to this variation, for example, lighting controller 410*a* further includes second filter 460 that converts second signal waveform 445 into a signal waveform defined by a smooth rounded curve, and outputs the converted signal waveform as the second output waveform, and output determiner 450*a* determines the intensity at which light is to be emitted by first light source 421 and the intensity at which light is to be emitted by second light source 422 based on first output waveform 131 and the second output waveform.

With this, it is possible to smoothly change the color (color temperature) of the illumination light in addition to the intensity of the illumination light. As such, it is possible to, for example, increase the relaxing effect of the illumination light and pleasantly lull user 2 to sleep.

Variation 2

Next, Variation 2 of Embodiment 4 will be described.

In Embodiment 4, second signal waveform 445 is exemplified as indicating the relationship between the intensity value of the first output waveform and a color temperature of the illumination light, but second signal waveform 445 is not limited to this example. As exemplified in this variation, second signal waveform 445 may indicate the amount of time elapsed and the color temperature of the illumination light.

More specifically, lighting controller 410 according to this variation causes light emitter 420 to begin monotonically decreasing the color temperature of the illumination light at the start point of the repeating of the increases and decreases in illumination light intensity. In other words, lighting controller 410 changes the color temperature of the illumination light in accordance with the amount of time elapsed from the initiation of the flicker mode.

Figure 15A:
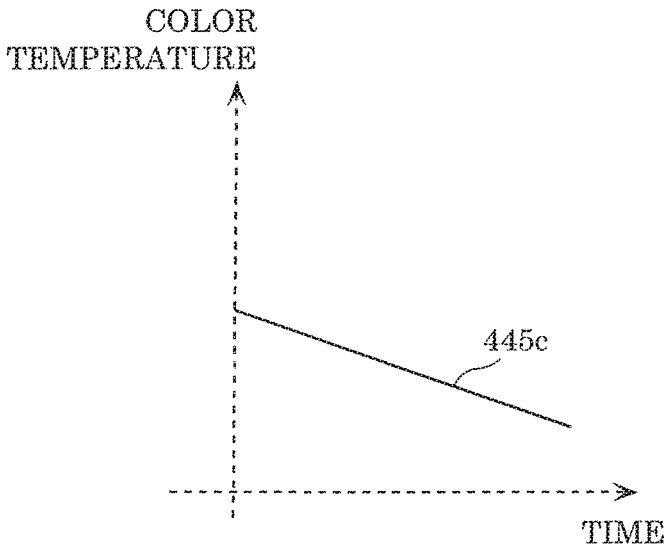
FIG. 15A illustrates one example of a second signal waveform according to Variation 2 of Embodiment 4.

FIG. 15A illustrates second signal waveform 445*c* according to this embodiment. In FIG. 15A, time is represented on the horizontal axis and color temperature is represented on the vertical axis. As illustrated in FIG. 15A, second signal waveform 445*c* is defined by a single straight line. More specifically, second signal waveform 445*c* is defined by a single straight line having a negative slope. Note that second signal waveform 445*c* may be defined by a piecewise linear curve that changes in steps.

Figure 15B:
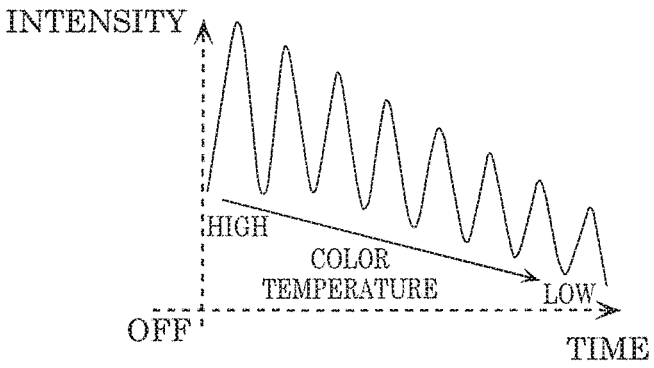
FIG. 15B illustrates one example of illumination light based on the second signal waveform illustrated in FIG. 15A.

FIG. 15B illustrates one example of illumination light based on second signal waveform 445*c* illustrated in FIG. 15A. As illustrated in FIG. 15B, the intensity of the illumination light repeatedly increases and decreases while the color temperature of the illumination light decreases at a constant rate over time. This rate of decrease corresponds to the slope of second signal waveform 445*c* illustrated in FIG. 15A.

In this way, with the lighting device according to this variation, for example, the color of the illumination light is the color temperature of the illumination light, and lighting controller 410 causes light emitter 420 to monotonically decrease the color temperature of the illumination light from the start point of the repeating of the increases and decreases in the intensity of the illumination light.

This makes it possible to repeatedly switch between bright and dark states while gradually decreasing the brightness of the illumination light over time, which in turn makes it possible to pleasantly lull user 2 to sleep.

Embodiment 5

Next, Embodiment 5 will be described.

In Embodiments 1 through 4 above, examples are given in which the first signal waveform defined by a piecewise linear curve is converted into a signal waveform defined by a smooth rounded curve by using a filter. In contrast, in this embodiment, description will focus on the characteristics of the illumination light that is controlled based on the filtered signal waveform.

(Configuration)

Figure 16:
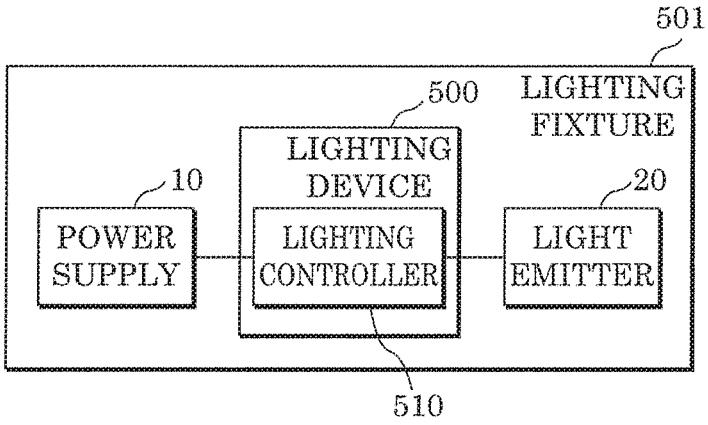
FIG. 16 illustrates a functional block diagram of the configuration of a lighting fixture including a lighting device according to Embodiment 5.

FIG. 16 illustrates a functional block diagram of the configuration of lighting fixture 501 including lighting device 500 according to this embodiment. As illustrated in FIG. 16, lighting fixture 501 includes power supply 10, lighting device 500, and light emitter 20.

Lighting device 500 is a device that turns on, turns off, and controls, for example, the dimming of light emitter 20. Lighting device 500 includes lighting controller 510 that controls light emitter 20.

Similar to lighting controller 110 according to Embodiment 1, lighting controller 510 causes light emitter 20 to operate in flicker mode. In flicker mode, the intensity of the illumination light emitted by light emitter 20 repeatedly increases and decreases while gradually decreasing over time.

In this embodiment, lighting controller 510 causes light emitter 20 to gradually decrease the maximum intensity value, the minimum intensity value, or both the maximum and minimum intensity values in each cycle of the repeating increases and decreases in the intensity of the illumination light (flickering illumination light). Hereinafter, specific examples of the flickering illumination light emitted by light emitter 20 will be given with reference to FIG. 17A through FIG. 17H.

First Example (Maximum Value Decrease)

In the first example, lighting controller 510 causes light emitter 20 to gradually decrease the maximum intensity value in each cycle of the repeating increases and decreases in the intensity of the illumination light.

Figure 17A:
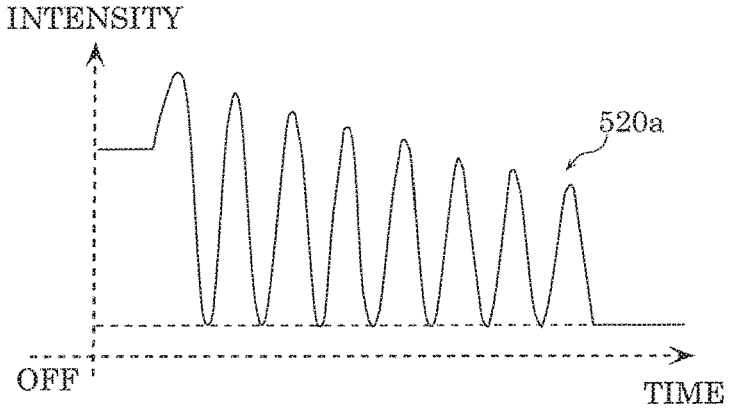
FIG. 17A illustrates a first example of the change in intensity over time of illumination light emitted by a light emitter controlled by a lighting device according to Embodiment 5.

FIG. 17A illustrates a first example of the change in intensity over time of the illumination light emitted by light emitter 20 controlled by lighting device 500 according to this embodiment. In FIG. 17A, time is represented on the horizontal axis and illumination light intensity is represented on the vertical axis. Note that this also applies to FIG. 17B through FIG. 17H, which will be described later.

In flickering illumination light 520*a* according to the first example, which is illustrated in FIG. 17A, the maximum intensity value in each cycle of the repeating increases and decreases in the intensity gradually decreases. In other words, the maximum intensity value per flicker (hereinafter referred to as maximum flicker value) gradually decreases. The rate of decrease is, for example, constant, but may change in steps or smoothly over time. For example, when the rate of decrease slowly increases from 0, flickering illumination light whose maximum flicker value starts off gently decreasing and then gradually decreases at a greater and greater rate is emitted. On the other hand, when the rate of decrease slowly decreases to 0, flickering illumination light whose maximum flicker value begins decreasing sharply and then gradually decreases more and more gently is emitted.

Note that in the first example, the minimum intensity value in a cycle of the repeating increases and decreases in the intensity of the illumination light remains constant at a predetermined intensity. In other words, the minimum intensity value remains constant in each flicker (hereinafter referred to as minimum flicker value). FIG. 17A illustrates an example in which the minimum flicker value is not 0, but the minimum flicker value may be 0.

Moreover, in the first example, the maximum flicker value is exemplified as gradually decreasing, but the minimum flicker value may gradually decrease.

Second Example (Maximum Value and Minimum Value Decrease at Constant Rate)

In the second example, lighting controller 510 causes light emitter 20 to gradually decrease both the maximum intensity value and minimum intensity value in each cycle of the repeating increases and decreases in the intensity of the illumination light at substantially equal rates.

Figure 17B:
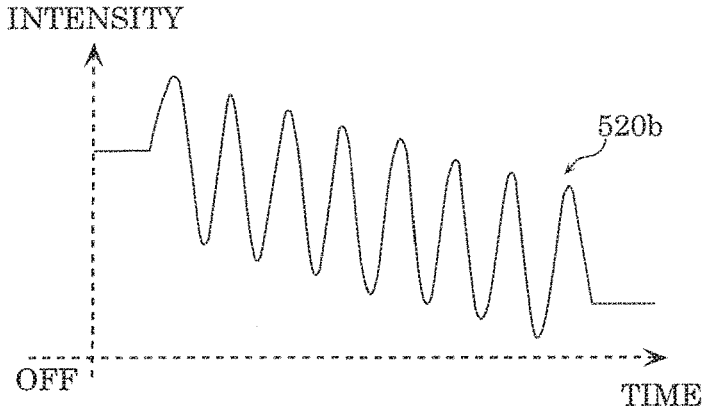
FIG. 17B illustrates a second example of the change in intensity over time of illumination light emitted by a light emitter controlled by a lighting device according to Embodiment 5.

FIG. 17B illustrates a second example of the change in intensity over time of the illumination light emitted by light emitter 20 controlled by lighting device 500 according to this embodiment.

In flickering illumination light 520*b* according to the second example, which is illustrated in FIG. 17B, both the maximum flicker value and minimum flicker value gradually decrease. The rate of decrease for both the maximum flicker value and minimum flicker value is, for example, constant, but may change in steps or smoothly over time. In these cases, the rate of decrease of the maximum flicker value and the rate of decrease of the minimum flicker value are the same. Accordingly, the peak-to-peak height of the flicker (the difference between the maximum value and the minimum value) remains constant in each flicker.

Third Example (Maximum Value and Minimum Value Decrease at Different Rates)

In the third example, lighting controller 510 causes light emitter 20 to gradually decrease the maximum intensity value and minimum intensity value in each cycle of the repeating increases and decreases in the intensity of the illumination light at mutually different rates.

Figure 17C:
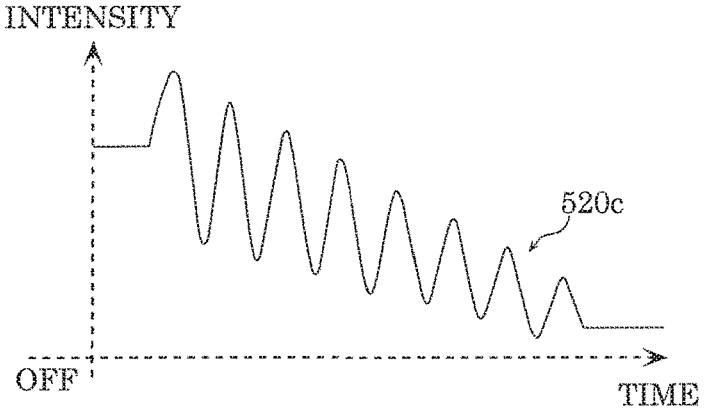
FIG. 17C illustrates a third example of the change in intensity over time of illumination light emitted by a light emitter controlled by a lighting device according to Embodiment 5.

FIG. 17C illustrates a third example of the change in intensity over time of the illumination light emitted by light emitter 20 controlled by lighting device 500 according to this embodiment.

In flickering illumination light 520*c* according to the second example, which is illustrated in FIG. 17C, both the maximum flicker value and minimum flicker value gradually decrease. The rate of decrease for both the maximum flicker value and minimum flicker value is, for example, constant, but may change in steps or smoothly over time. In these cases, the rate of decrease of the maximum flicker value is greater than the rate of decrease of the minimum flicker value. Accordingly the peak-to-peak height of the flicker gradually decreases with each flicker.

Fourth Example (Combination of First Example and Second Example)

In the fourth example, lighting controller 510 causes light emitter 20 to maintain the minimum value in each cycle at a predetermined value for a first period of time, and subsequently gradually decrease the minimum value.

Figure 17D:
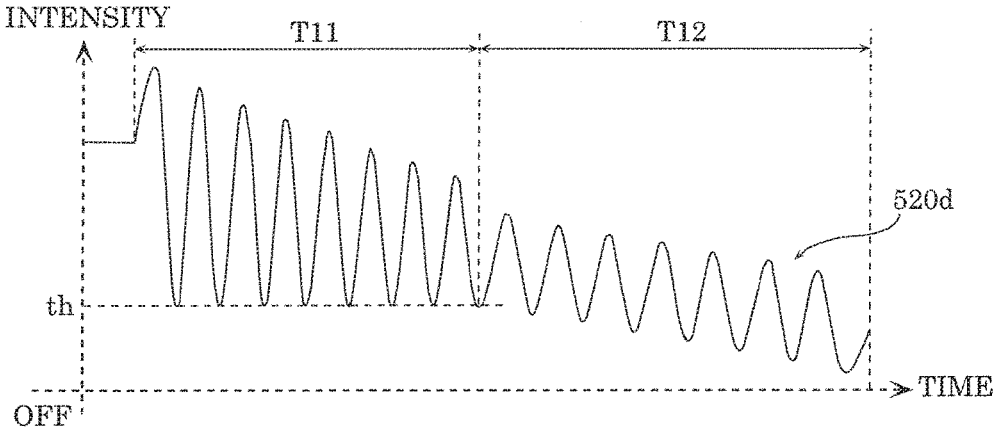
FIG. 17D illustrates a fourth example of the change in intensity over time of illumination light emitted by a light emitter controlled by a lighting device according to Embodiment 5.

FIG. 17D illustrates a fourth example of the change in intensity over time of the illumination light emitted by light emitter 20 controlled by lighting device 500 according to this embodiment.

The flickering illumination light 520*d* according to the fourth example, which is illustrated in FIG. 17D, is a combination of flickering illumination light 520*a* according to the first example and flickering illumination light 520*b* according to the second example. More specifically, in period T11, the minimum flicker value of flickering illumination light 520*d* remains constant and the maximum flicker value of flickering illumination light 520*d* decreases at a predetermined rate. In period T12, both the maximum flicker value and the minimum flicker value decrease at a predetermined rate. Period T11 and period T12 may be the same length. Alternatively, one may be longer than the other.

Note that in this example, the first example and the second example are combined, but the combination is not limited to the first and second examples; any two or more of the first through eighth examples described hereinbefore and hereinafter may be combined. The number and order of examples combined is not limited.

Fifth Example

In the fifth example, lighting controller 510 causes light emitter 20 to gradually decrease the maximum value or minimum value in each cycle for a second period of time, and subsequently set the minimum value to 0. More specifically, lighting controller 510 momentarily turns off light emitter 20 in each flicker after elapse of a second period of time starting when the flicker mode is implemented.

Figure 17E:
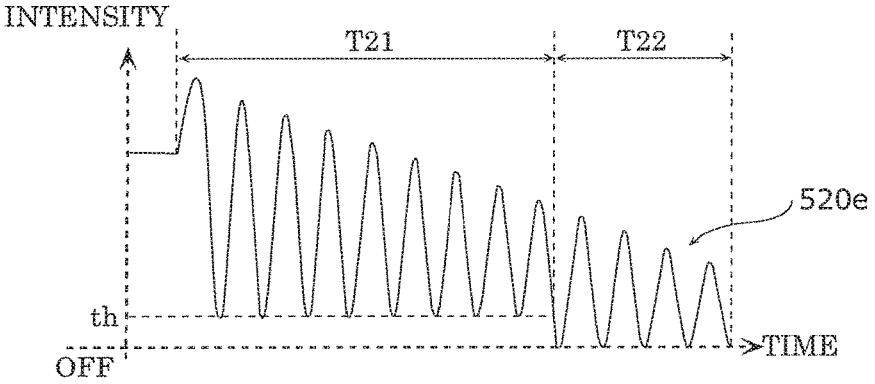
FIG. 17E illustrates a fifth example of the change in intensity over time of illumination light emitted by a light emitter controlled by a lighting device according to Embodiment 5.

FIG. 17E illustrates a fifth example of the change in intensity over time of the illumination light emitted by light emitter 20 controlled by lighting device 500 according to this embodiment.

In period T21, similar to flickering illumination light 520*a* according to the first example, the minimum flicker value of flickering illumination light 520*e* according to the fifth example, which is illustrated in FIG. 17E, is maintained approximately constant at a predetermined value that is not 0 and the maximum flicker value decreases at a predetermined rate. In period T22 after period T21, the minimum flicker value remains constant at 0 and the maximum flicker value decreases at a predetermined rate. Here, the rate of decrease of the maximum flicker value is the same in period T21 and period T22, but the rate of decrease may be different in period T21 and period T22. Period T21 and period T22 may be the same length. Alternatively, one may be longer than the other.

Sixth Example

In the sixth example, when the minimum intensity value in a cycle is 0, lighting controller 510 causes light emitter 20 to maintain the minimum intensity value at 0 for a third period of time. More specifically, lighting controller 510 implements an off period in each instance of a flicker in flicker mode.

Figure 17F:
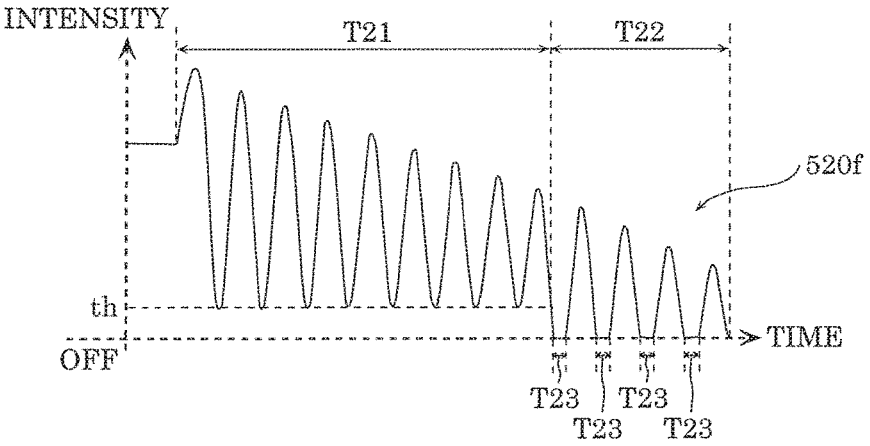
FIG. 17F illustrates a sixth example of the change in intensity over time of illumination light emitted by a light emitter controlled by a lighting device according to Embodiment 5.

FIG. 17F illustrates a sixth example of the change in intensity over time of the illumination light emitted by light emitter 20 controlled by lighting device 500 according to this embodiment.

In period T21, flickering illumination light 520*f* according to the sixth example, which is illustrated in FIG. 17F, is the same as flickering illumination light 520*e* exemplified in the fifth example. In period T22, flickering illumination light 520*f* includes off period T23 during which the minimum flicker value is maintained at 0. In FIG. 17F, flickering illumination light 520*f* includes four off periods T23 of equal length.

Seventh Example

In the seventh example, when the minimum intensity value in a cycle is 0, lighting controller 510 causes light emitter 20 to set the maximum intensity value in the cycle to a first value. More specifically, when lighting controller 510 implements an off period in each instance of a flicker in flicker mode, lighting controller 510 maintains the maximum flicker value at an approximately constant value.

Figure 17G:
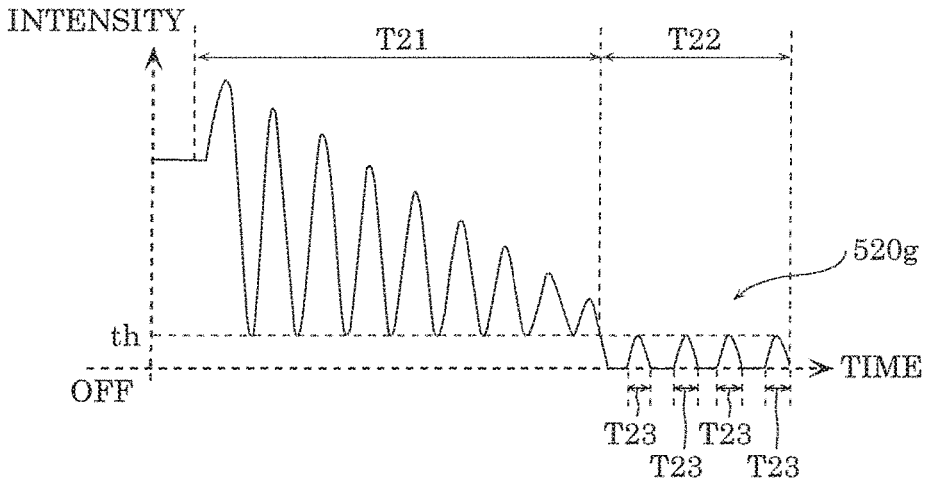
FIG. 17G illustrates a seventh example of the change in intensity over time of illumination light emitted by a light emitter controlled by a lighting device according to Embodiment 5.

FIG. 17G illustrates a seventh example of the change in intensity over time of the illumination light emitted by light emitter 20 controlled by lighting device 500 according to this embodiment.

In period T21, flickering illumination light 520*g* according to the seventh example, which is illustrated in FIG. 17G, is the same as flickering illumination light 520*e* exemplified in the fifth example, and in period T22, flickering illumination light 520*g* includes off period T23, similar to flickering illumination light 520*f* exemplified in the sixth example. In period T22, the maximum flicker value of flickering illumination light 520*g* is maintained at the value "th". Note that the value "th" is the same as the minimum flicker value in period T21, but the value "th" is not limited to this example. The value "th" may be smaller or larger than the minimum flicker value in period T21.

Eighth Example

In the eighth example, when lighting controller 510 implements an off period in each instance of a flicker in flicker mode, lighting controller 510 gradually increases the length of each off period.

Figure 17H:
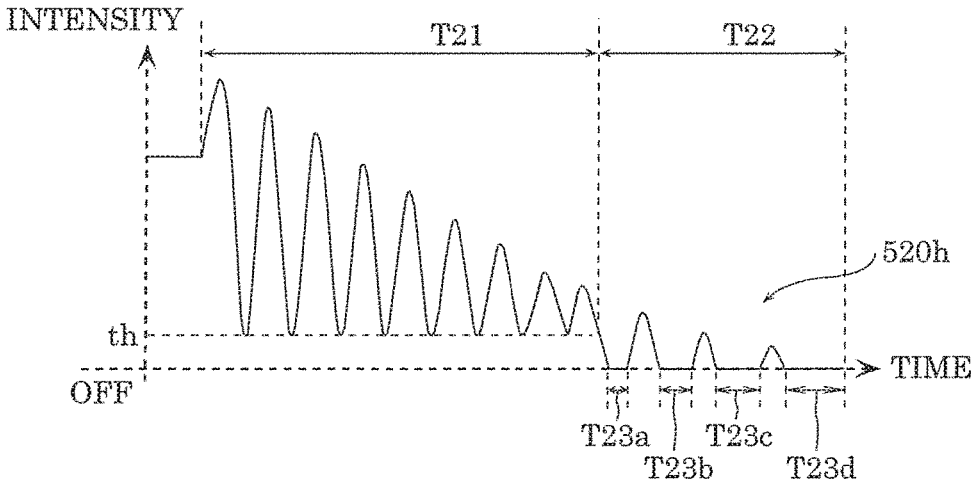
FIG. 17H illustrates an eighth example of the change in intensity over time of illumination light emitted by a light emitter controlled by a lighting device according to Embodiment 5.

FIG. 17H illustrates an eighth example of the change in intensity over time of the illumination light emitted by light emitter 20 controlled by lighting device 500 according to this embodiment.

In period T21, flickering illumination light 520*h* according to the eighth example, which is illustrated in FIG. 17H, is the same as flickering illumination light 520*g* exemplified in the seventh example, and in period T22, flickering illumination light 520*h* includes a plurality of off periods T23*a* through T23*d*, similar to flickering illumination light 520*g* exemplified in the seventh example. The plurality of off periods T23*a* through T23*d* gradually increase in length with each cycle, that is to say, with each flicker. In other words, in period T22 of flickering illumination light 520*h*, the "off" time becomes longer with each flicker.

(Technical Advantages, Etc.)

As described above, with lighting device 500 according to this embodiment, lighting controller 510 causes light emitter 20 to gradually decrease the maximum intensity value, the minimum intensity value, or both the maximum and minimum intensity values in each cycle of the repeating increases and decreases in the intensity of the illumination light.

With this, in the repeating of the increases and decreases in intensity, at least one of the maximum value and the minimum value decreases, whereby the emitted flickering illumination light gradually becomes darker over time. This makes it possible to pleasantly lull user 2 to sleep.

Moreover, for example, lighting controller 510 causes light emitter 20 to maintain the minimum value in each cycle at a predetermined value for period T11, and subsequently gradually decrease the minimum value.

This makes it possible to maintain a brightness that is brighter than or equal to a predetermined brightness without turning the light emitter off in the first period after initiation of the flicker mode. Accordingly, this makes it possible to inhibit a sudden drop in brightness and pleasantly lull user 2 to sleep.

Moreover, for example, lighting controller 510 causes light emitter 20 to gradually decrease the maximum intensity value or the minimum intensity value in each cycle for period T21, and subsequently set the minimum intensity value to 0.

This makes it possible to momentarily turn off the illumination light in each instance of a flicker and gradually reduce the brightness of the illumination light in conjunction with user 2 falling asleep. Since the intensity of the illumination light can be set to 0, this makes it possible to reduce power consumption.

Moreover, for example, when the minimum intensity value in a cycle is 0, lighting controller 510 causes light emitter 20 to maintain the minimum intensity value at 0 for a predetermined period of time (off time T23).

Since each instance of a flicker includes an off period, it is possible to prolong the period of time that the illumination light is dark in conjunction with user 2 falling deeper asleep. Since a period is provided in which the intensity of the illumination light can be set to 0, this makes it possible to reduce power consumption.

Moreover, for example, off period T23 may gradually increase in length with each cycle.

Since the length of the off period can be gradually increased, it possible to further reduce power consumption.

Moreover, for example, after the minimum intensity value in a cycle is 0, lighting controller 510 may cause light emitter 20 to set the maximum intensity value to a first value (for example, the value "th").

This makes it possible to prevent the illumination light from becoming too bright after the light becomes dark. Moreover, since the maximum intensity value of the illumination light can be held to a first value or less, it possible to further reduce power consumption.

Embodiment 6

Next, Embodiment 6 will be described.

Similar to Embodiment 4, in this embodiment as well, the light emitter includes a plurality of light sources, and the color of the illumination light can be changed.

(Configuration)

Figure 18:
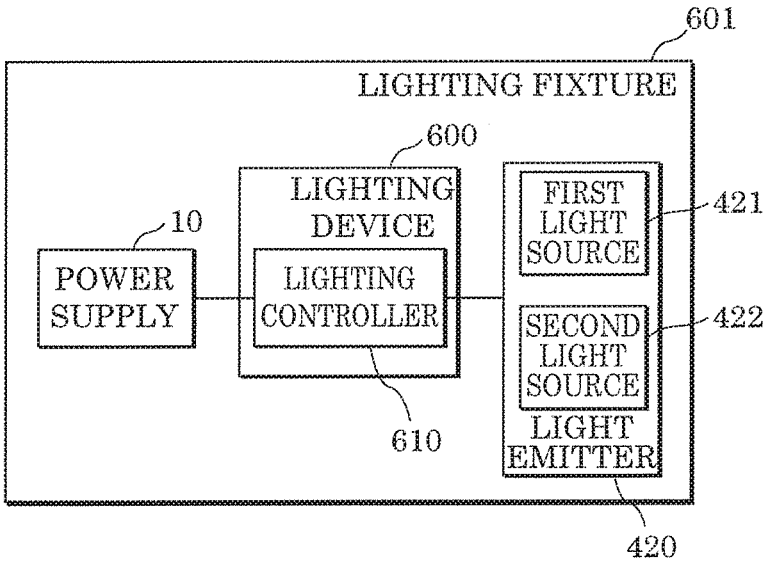
FIG. 18 illustrates a functional block diagram of the configuration of a lighting fixture including a lighting device according to Embodiment 6.

FIG. 18 illustrates a functional block diagram of the configuration of lighting fixture 601 including lighting device 600 according to this embodiment. As illustrated in FIG. 18, lighting fixture 601 includes power supply 10, lighting device 600, and light emitter 420.

Lighting device 600 is a device that turns on, turns off, and controls, for example, the dimming of light emitter 420. Lighting device 600 includes lighting controller 610 that controls light emitter 420.

Similar to lighting controller 410 according to Embodiment 4, lighting controller 610 causes light emitter 420 to operate in flicker mode. In flicker mode, the intensity of the illumination light emitted by light emitter 420 repeatedly increases and decreases while gradually decreasing over time, and the color of the illumination light is changed based on a predetermined condition.

When the intensity of the illumination light is less than or equal to a second value, lighting controller 610 causes light emitter 420 to emit light using only first light source 421 among first light source 421 and second light source 422. Note that light emitted by first light source 421 is lower in color temperature than the light emitted by second light source 422.

In this embodiment, after the minimum intensity value in a cycle reaches 0, lighting controller 610 causes light emitter 420 to emit light using only first light source 421 among first light source 421 and second light source 422. More specifically, in flicker mode, when light of a brightness lower than the second value (i.e., dark light) is emitted, lighting controller 610 reduces the color temperature of the dark light. For example, in flicker mode, the dark light is light having the color of an incandescent bulb, and bright light is light of daytime color or daylight color.

Hereinafter, specific examples of the flickering illumination light emitted by light emitter 420 will be given with reference to FIG. 19A through FIG. 19C.

Figure 19A:
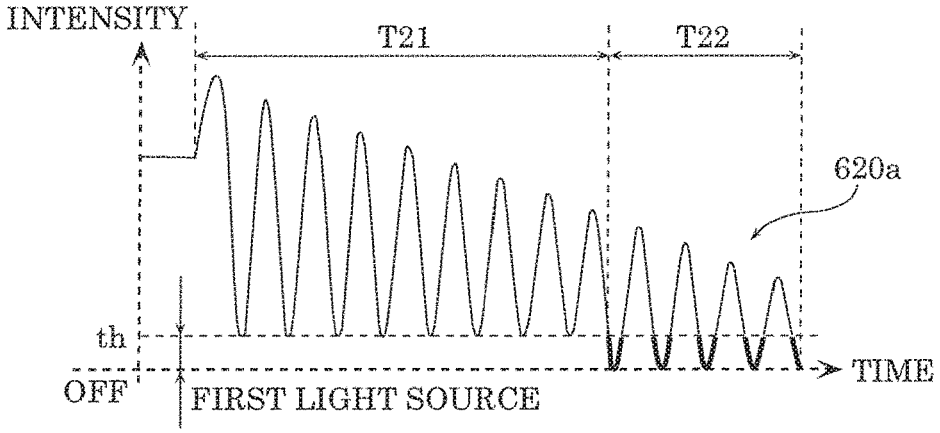
FIG. 19A illustrates a first example of the change in intensity over time of illumination light emitted by a light emitter controlled by a lighting device according to Embodiment 6.
Figure 19B:
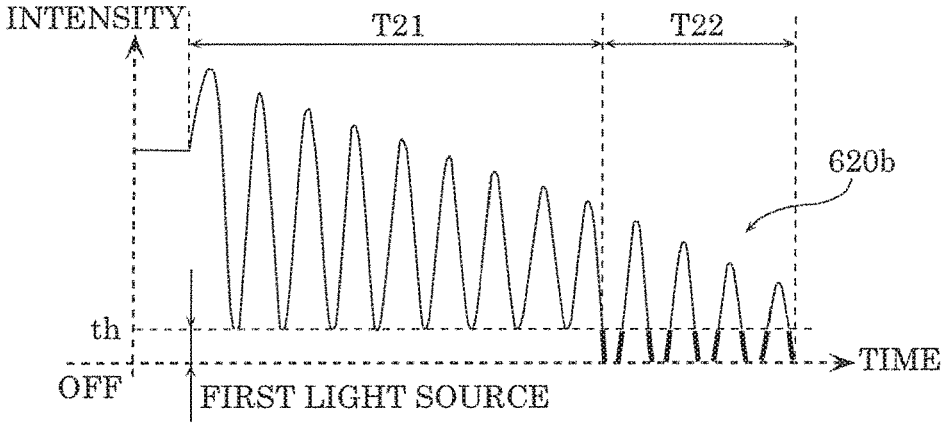
FIG. 19B illustrates a second example of the change in intensity over time of illumination light emitted by a light emitter controlled by a lighting device according to Embodiment 6.
Figure 19C:
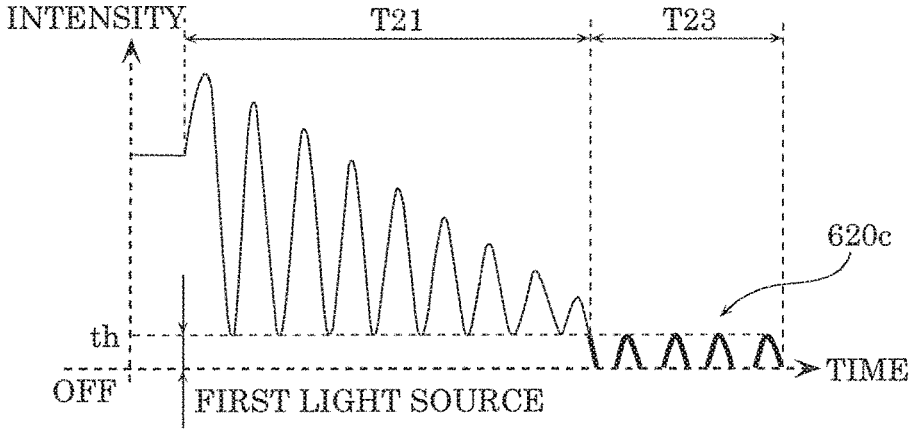
FIG. 19C illustrates a third example of the change in intensity over time of illumination light emitted by a light emitter controlled by a lighting device according to Embodiment 6.

FIG. 19A through FIG. 19C illustrate first through third examples, respectively, of the change in intensity over time of the illumination light emitted by light emitter 420 controlled by lighting device 600 according to this embodiment.

Flickering illumination light 620*a* according to the first example, which is illustrated in FIG. 19A, corresponds to flickering illumination light 520*e* exemplified in the fifth example given in Embodiment 5. In other words, the change in intensity over time is the same in flickering illumination light 620*a* and flickering illumination light 520*e*. Similarly, flickering illumination light 620*b* according to the second example, which is illustrated in FIG. 19B, corresponds to flickering illumination light 520*f* exemplified in the sixth example given in Embodiment 5. Flickering illumination light 620*c* according to the third example, which is illustrated in FIG. 19C, corresponds to flickering illumination light 520*g* exemplified in the seventh example given in Embodiment 5.

As illustrated in FIG. 19A through FIG. 19C, when the intensity is less than the value "th", lighting controller 610 emits light using only first light source 421. Moreover, when the intensity is greater than or equal to the value "th", lighting controller 610 emits light using both first light source 421 and second light source 422. Note that in FIG. 19A through FIG. 19C, the bold lines correspond to light emission using only first light source 421.

Here, the value "th" is equal to the minimum flicker value in period T21. Accordingly, in period T21, a combination of light from both first light source 421 and second light source 422 is emitted from light emitter 420. Accordingly, in period T21, light whose color temperature is dependent on the combination of light from first light source 421 and second light source 422 is emitted as flickering illumination light.

(Technical Advantages, Etc.)

As described above, with lighting device 600 according to this embodiment, for example, light emitter 420 includes first light source 421 and second light source 422 that emits light having a higher color temperature than the light emitted by first light source 421, and when the intensity of the illumination light is smaller than a second value (the value "th"), lighting controller 610 causes light emitter 420 to emit light using only first light source 421 from among first light source 421 and second light source 422.

More specifically, the extent to which a high color temperature light source (second light source 422) can be dimmed is limited (i.e., it is difficult to dim such a light source to a significantly low dimming rate), making it difficult to emit light at a stable intensity. With lighting device 600 according to this embodiment, since only first light source 421 is used to emit light when the intensity is low, dimming can be performed effortlessly.

Moreover, for example, after the minimum intensity value in a cycle reaches 0, lighting controller 610 causes light emitter 420 to emit light using only first light source 421 among first light source 421 and second light source 422.

With this, after the illumination light is turned off in an instance of a flicker, it is possible achieve extensive dimming by causing light to be emitted using only first light source 421, and thus possible to emit illumination light that pleasantly lulls user 2 to sleep.

(Other Comments)

Hereinbefore, the lighting device, electronic device, and lighting fixture according to the present disclosure have been described based on exemplary embodiments and variations thereof, but the present disclosure is not limited to the above exemplary embodiments.

For example, in the above embodiments, the magnitude of the modulation waveform along the time axis is constant throughout, but this example is not limiting. The magnitude of the modulation waveform along the time axis may be changed. Accordingly, the time span of a flicker (the temporal length of a single flicker) may vary from flicker to flicker.

Moreover, for example, in the above embodiments, first reference waveform 222 and second reference waveform 324 are exemplified as being representations of a monotonically decreasing function, but this example is not limiting. First reference waveform 222 and second reference waveform 324 may be representations of a monotonically increasing function. Alternatively, first reference waveform 222 and second reference waveform 324 may be defined by piecewise linear curves including positive and negative slopes.

Moreover, for example, in the above embodiments, light emitter 420 is exemplified as including first light source 421 and second light source 422 that emit light of different color temperatures, but this example is not limiting. Light emitter 420 may include a plurality of light sources that emit light of different colors. For example, light emitter 420 may include a red (R) light source, a green (G) light source, and a blue (B) light source. Adjusting the light intensities of (amount of light output by) the red, green, and blue light sources allows light emitter 420 to emit chromatic light other than white light.

Moreover, for example, in the above embodiments, lighting fixture 1 or electronic device 4 is exemplified as emitting flickering illumination light that can pleasantly lull user 2 to sleep, but this example is not limiting. For example, since 1/f flicker has a relaxing effect, illumination light may be emitted to user 2 relaxing in, for example, a living room. Moreover, in addition to inducing a relaxing effect, the flickering illumination light (blinking light) may be used to notify of an emergency, for example, by repeatedly increasing and decreasing intensity.

Moreover, in the above embodiments, each element may be configured as dedicated hardware or realized by executing a software program suitable for the elements. Each element may be realized as a result of a program execution unit of a central processing unit (CPU) or processor or the like reading and executing a software program stored on a storage medium such as a hard disk or semiconductor memory.

Note that the present disclosure is not limited to being embodied as a lighting device; the present disclosure may be realized as a program including the processes performed by the elements in the lighting device as steps, and as a computer-readable storage medium, such as a digital versatile disc (DVD), on which such a program is recorded.

In other words, general or specific aspects of the present disclosure may be realized as a system, device, integrated circuit, computer program, computer readable storage medium, or any given combination thereof.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting device, comprising:

a lighting controller that controls a light emitter that emits illumination light, wherein the lighting controller:

includes a first filter that converts a first signal waveform that is defined by a first piecewise linear curve and whose intensity repeatedly increases and decreases into a signal waveform defined by a smooth rounded curve, and outputs the converted signal waveform as a first output waveform; and causes the light emitter to repeatedly increase and decrease an intensity of the illumination light in accordance with the first output waveform, wherein the lighting controller further includes a signal waveform generator that generates the first signal waveform by repeatedly superimposing a modulation waveform onto a first reference waveform and outputs the first signal waveform to the first filter, the first reference waveform is defined by a first single straight line or a second piecewise linear curve, and the modulation waveform is defined by a third piecewise linear curve having a start point, an end point, and a peak between the start point and the end point.

2. The lighting device according to claim 1, wherein the third piecewise linear curve has at least two points, including the peak, between the start point and the end point.

3. The lighting device according to claim 2, wherein the at least two points include a point between the start point and the peak at an intensity that is less than half an intensity of the peak.

4. The lighting device according to claim 1, wherein the first reference waveform is a representation of a monotonically decreasing function.

5. The lighting device according to claim 1, wherein when repeatedly superimposing the modulation waveform onto the first reference waveform, the lighting controller positions the start point and the end point of each repetition of the modulation waveform on the first single straight line or the second piecewise linear curve defining the first reference waveform and positions the start point of each repetition of the modulation waveform at the end point of an immediately preceding repetition.

6. The lighting device according to claim 5, wherein when repeatedly superimposing the modulation waveform onto the first reference waveform, the lighting controller positions the peak of each repetition of the modulation waveform on a second single straight line or a fourth piecewise linear curve defining a second reference waveform.

7. The lighting device according to claim 6, wherein the first reference waveform and the second reference waveform are identical in shape.

8. The lighting device according to claim 6, wherein the second reference waveform includes a section whose rate of decrease is greater than a rate of decrease of the first reference waveform.

9. The lighting device according to claim 1, wherein the light emitter includes a first light source and a second light source that emit light of mutually different colors, the lighting controller:

further includes an output determiner that determines an intensity at which light is to be emitted by the first light source and an intensity at which light is to be emitted by the second light source based on the first output waveform and a second signal waveform defined by a single straight line or a second piecewise linear curve; and repeatedly increases and decreases the intensity of the illumination light in accordance with the first output waveform and changes a color of the illumination light, by causing the first light source and the second light source to emit light at the intensities determined by the output determiner.

10. The lighting device according to claim 9, wherein the lighting controller further includes a second filter that converts the second signal waveform into a signal waveform defined by a smooth rounded curve, and outputs the converted signal waveform as a second output waveform, and the output determiner determines the intensity at which light is to be emitted by the first light source and the intensity at which light is to be emitted by the second light source based on the first output waveform and the second output waveform.

11. The lighting device according to claim 9, wherein the lighting controller causes the light emitter to start changing the color of the illumination light from a start point of the repeating of the increases and the decreases in the intensity of the illumination light.

12. The lighting device according to claim 9, wherein in a cycle of the repeating increases and decreases in the intensity of the illumination light, the lighting controller causes the light emitter to change the color of the illumination light in accordance with a relative increase and decrease in the intensity within the cycle.

13. The lighting device according to claim 9, wherein the lighting controller causes the light emitter to change the color of the illumination light in accordance with an absolute value of the intensity of the illumination light.

14. The lighting device according to claim 9, wherein the color of the illumination light is a color temperature of the illumination light, and the lighting controller causes the light emitter to monotonically decrease the color temperature of the illumination light from a start point of the repeating of the increases and the decreases in the intensity of the illumination light.

15. The lighting device according to claim 1, wherein the lighting controller causes the light emitter to gradually decrease at least one of a minimum intensity value and a maximum intensity value in each cycle of the repeating increases and decreases in the intensity of the illumination light.

16. The lighting device according to claim 15, wherein the lighting controller causes the light emitter to maintain the minimum intensity value in each of the cycles at a predetermined value for a first period of time, and subsequently gradually decrease the minimum intensity value.

17. The lighting device according to claim 15, wherein the lighting controller causes the light emitter to gradually decrease one of the maximum intensity value and the minimum intensity value in each of the cycles for a second period of time, and subsequently set the minimum intensity value to 0.

18. The lighting device according to claim 15, wherein when the minimum intensity value in the cycle is 0, the lighting controller causes the light emitter to maintain the minimum intensity value at 0 for a third period of time.

19. The lighting device according to claim 18, wherein the third period of time gradually increases in length with each cycle.

* * * * *